US012043884B2

(12) United States Patent
Hirashima et al.

(10) Patent No.: US 12,043,884 B2
(45) **Date of Patent: *Jul. 23, 2024**

(54) HIGH-DUCTILITY, HIGH-STRENGTH ELECTROLYTIC ZINC-BASED COATED STEEL SHEET AND METHOD FOR PRODUCING THE SAME

(71) Applicant: JFE Steel Corporation, Tokyo (JP)

(72) Inventors: Takuya Hirashima, Tokyo (JP); Shinjiro Kaneko, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 549 days.

This patent is subject to a terminal disclaimer.

(21) Appl. No.: 17/285,166

(22) PCT Filed: Aug. 6, 2019

(86) PCT No.: PCT/JP2019/030793

§ 371 (c)(1),
(2) Date: Apr. 14, 2021

(87) PCT Pub. No.: WO2020/079926

PCT Pub. Date: Apr. 23, 2020

(65) Prior Publication Data

US 2021/0324504 A1 Oct. 21, 2021

(30) Foreign Application Priority Data

Oct. 18, 2018 (JP) ..... 2018-196591

(51) Int. Cl.

| | |
|---|---|
| ***C22C 38/06*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C25D 3/22*** | (2006.01) |

(52) U.S. Cl.
CPC ..... *C22C 38/06* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/02* (2013.01); *C22C 38/04* (2013.01); *C25D 3/22* (2013.01); *C21D 2211/002* (2013.01); *C21D 2211/008* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 8,449,988 | B2 | 5/2013 | Shiraki et al. | |
| 9,121,087 | B2 | 9/2015 | Matsuda et al. | |
| 2012/0132327 | A1* | 5/2012 | Mukai | C21D 8/0236 148/333 |
| 2012/0222781 | A1* | 9/2012 | Azuma | C25D 5/36 148/330 |
| 2013/0199679 | A1* | 8/2013 | Toji | B21D 22/022 148/653 |
| 2013/0295402 | A1 | 11/2013 | Oh et al. | |
| 2017/0218475 | A1 | 8/2017 | Kawasaki et al. | |
| 2018/0100212 | A1* | 4/2018 | Ono | C21D 8/0236 |
| 2018/0363088 | A1 | 12/2018 | Tsuzumi et al. | |
| 2020/0032364 | A1* | 1/2020 | Hirashima | C21D 8/0226 |
| 2020/0172991 | A1 | 6/2020 | Takashima et al. | |

FOREIGN PATENT DOCUMENTS

| | | | |
|---|---|---|---|
| CN | 103842543 | A | 6/2014 |
| EP | 2762583 | A1 | 8/2014 |
| EP | 3486346 | A1 | 5/2019 |
| EP | 3489382 | A1 | 5/2019 |
| EP | 3550050 | A1 | 10/2019 |
| JP | 200080418 | A | 3/2000 |
| JP | 2010090475 | A | 4/2010 |
| JP | 2011231377 | A | 11/2011 |
| JP | 2011246746 | A | 12/2011 |
| JP | 2014508854 | A | 4/2014 |
| JP | 6414371 | B1 | 10/2018 |

(Continued)

OTHER PUBLICATIONS

Chinese Office Action for Chinese Application No. 201980068231.7, dated May 30, 2022 with Concise Statement of Relevance of Office Action, 6 pages.
Korean Office Action for Korean Application No. 10-2021-7011163, dated Oct. 1, 2022, with Concise Statement of Relevance of Office Action, 7 pages.
Chinese Office Action for Chinese Application No. 201980068231.7, dated Nov. 30, 2021 with Search Report, 9 pages.

(Continued)

*Primary Examiner* — Jophy S. Koshy

(74) *Attorney, Agent, or Firm* — Buchanan Ingersoll & Rooney PC

(57) ABSTRACT

A high-ductility, high-strength electrolytic zinc-based coated steel sheet includes an electrolytic zinc-based coating on a base steel sheet, in which the base steel sheet has a predetermined composition and a steel microstructure in which the total area percentage of one or two of martensite containing a carbide having an average particle size of 50 nm or less and bainite containing a carbide having an average particle size of 50 nm or less is 90% or more in the entire steel microstructure, the total area percentage of one or two of the martensite containing a carbide having an average particle size of 50 nm or less and the bainite containing a carbide having an average particle size of 50 nm or less is 80% or more in a region extending from the surface of the base steel sheet to a depth of ⅛ of the thickness of the base steel sheet.

10 Claims, No Drawings

(56) References Cited

FOREIGN PATENT DOCUMENTS

| | | | | |
|---|---|---|---|---|
| WO | 2016021195 | A1 | 2/2016 | |
| WO | WO-2016152163 | A1 * | 9/2016 | ..... C21D 8/0236 |
| WO | 2017026125 | A1 | 2/2017 | |
| WO | 2018062380 | A1 | 4/2018 | |
| WO | 2018062381 | A1 | 4/2018 | |
| WO | 2018146828 | A1 | 8/2018 | |
| WO | 2019003538 | A1 | 1/2019 | |

OTHER PUBLICATIONS

Korean Written Decision on Registration for Korean Application No. 10-2021-7011163, dated Mar. 23, 2023 with translation, 4 pages.

Kodym, M. et al., Autorenkollektiv: "Spurenelemente im Stahl—Meoglichkeiten zur Beeinflussung im Smelzbetrieb, Trace Elements in Steel—Possibilities for Influencing the Smelting Operation," Jan. 1, 1985, 5 pages, XP002433212 (partial English translation).

Bell, S., et al., "Final Report on Effect of Impurities in Steel," Report No. 2005-41(CF), Mar. 1, 2006, 24 pages, XP009508207, Final Report of Natural Resources Canada, Natural Resources Canada, Retrieved from the Internet: https://www.researchgate.net/publication/306293969?channel=doi&linkId=57b7493708aec9984ff2a51f&showFulltext=true.

Extended European Search Report for European Application No. 19 873 988.0, dated May 4, 2021, 10 pages.

International Search Report and Written Opinion for International Application No. PCT/JP2019/030793, dated Nov. 5, 2019, 7 pages.

European Communication pursuant to Article 94(3) for European Application No. 19 873 988.0, dated Aug. 8, 2023, 6 pages.

* cited by examiner

HIGH-DUCTILITY, HIGH-STRENGTH ELECTROLYTIC ZINC-BASED COATED STEEL SHEET AND METHOD FOR PRODUCING THE SAME

CROSS REFERENCE TO RELATED APPLICATIONS

This is the U.S. National Phase application of PCT/JP2019/030793, filed Aug. 6, 2019, which claims priority to Japanese Patent Application No. 2018-196591, filed Oct. 18, 2018, the disclosures of these applications being incorporated herein by reference in their entireties for all purposes.

FIELD OF THE INVENTION

The present invention relates to a high-ductility, high-strength electrolytic zinc-based coated steel sheet and a method for producing the same. More specifically, the present invention relates to a high-ductility, high-strength electrolytic zinc-based coated steel sheet used, for example, for automotive components and a method for producing the same, and in particular, to a high-ductility, high-strength electrolytic zinc-based coated steel sheet excellent in bendability and a method for producing the same.

BACKGROUND OF THE INVENTION

In recent years, efforts have been actively made to reduce the weight of vehicle bodies themselves. The thicknesses of steel sheets used for vehicle bodies have been reduced by increasing the strength of steel sheets. In particular, there have been advances in the use of high-strength steel sheets with 1,320 to 1,470 MPa-grade tensile strength (TS) to vehicle frame components, such as center pillar reinforcements (R/F), bumpers, and impact beam components (hereinafter, also referred to as "components"). Furthermore, from the viewpoint of further reducing the weight of automotive bodies, studies have been conducted on the use of sheets of TS 1,800 MPa (1.8 GPa) or higher grade steels. Additionally, from the viewpoint of workability, there is a growing demand for steel sheets with bendability.

With an increase in the strength of steel sheets, hydrogen embrittlement may occur. In recent years, it has been suggested that plating hinders the release of hydrogen that has entered a steel sheet during the production process of the steel sheet and there is the risk of a decrease in ductility, in particular, local ductility. It has also been suggested that the accumulation of hydrogen in steel around coarse carbides in a surface layer of steel promotes the occurrence of cracking upon working.

For example, Patent Literature 1 provides a high-strength steel sheet having a chemical composition containing C: 0.12% to 0.3%, Si: 0.5% or less, Mn: less than 1.5%, P: 0.02% or less, S: 0.01% or less, Al: 0.15% or less, and N: 0.01% or less, the balance being Fe and incidental impurities, the steel sheet having a single tempered martensite microstructure and a tensile strength of 1.0 to 1.8 GPa.

Patent Literature 2 provides a high-strength steel sheet composed of a steel having a chemical composition containing C: 0.17% to 0.73%, Si: 3.0% or less, Mn: 0.5% to 3.0%, P: 0.1% or less, S: 0.07% or less, Al: 3.0% or less, and N: 0.010% or less, the balance being Fe and incidental impurities, the steel sheet having a good balance between strength and ductility and a tensile strength of 980 MPa to 1.8 GPa, in which the increased strength of the steel sheet is obtained by the use of a martensite microstructure, retained austenite required to provide the TRIP effect is stably provided by the use of upper bainite transformation, and martensite is partially transformed into tempered martensite.

PATENT LITERATURE

PTL 1: Japanese Unexamined Patent Application Publication No. 2011-246746

PTL 2: Japanese Unexamined Patent Application Publication No. 2010-90475

SUMMARY OF THE INVENTION

In the technique disclosed in Patent Literature 1, although the single tempered martensite microstructure results in excellent strength, inclusions and coarse carbides that promote crack growth cannot be reduced; thus, the steel sheet is not considered to be excellent in bendability.

In the technique disclosed in Patent Literature 2, although there is no description of bendability, austenite having an fcc structure has a larger amount of hydrogen dissolved therein than martensite and bainite having a body-centered cubic (bcc) structure or a body-centered tetragonal (bct) structure; thus, the steel specified in Patent Literature 2, which contains a large amount of austenite, seemingly contains a large amount of diffusible hydrogen therein and is not considered to be excellent in bendability.

Aspects of the present invention aim to provide a high-ductility, high-strength electrolytic zinc-based coated steel sheet having excellent bendability and a method for producing the steel sheet.

In accordance with aspects of the present invention, the term "high-ductility, high-strength" refers to a tensile strength (TS) of 1,320 MPa or more, an elongation (El) of 7.0% or more, and TS×El=12,000 or more. The term "excellent (in) bendability" indicates that limit bending radius/thickness (R/t) is 4.0 or less in a predetermined bending test.

In an electrolytic zinc-based coated steel sheet, a surface of a base steel sheet refers to the interface between the base steel sheet and an electrolytic zinc-based coating.

A region extending from a surface of the base steel sheet to a depth of ⅛ of the thickness of the base steel sheet is also referred to as a "surface layer portion".

Aspects of the present invention provide a high-ductility, high-strength electrolytic zinc-based coated steel sheet containing a predetermined amount of fine carbides in a surface layer portion to reduce the amount of diffusible hydrogen in steel and thus having excellent bendability, and a method for producing the steel sheet.

Specifically, a high-ductility, high-strength electrolytic zinc-based coated steel sheet according to aspects of the present invention includes a layer of electrolytic zinc-based coating on a surface of a base steel sheet and has a steel microstructure in which the total area percentage of one or two of martensite containing a carbide having an average particle size of 50 nm or less and bainite containing a carbide having an average particle size of 50 nm or less is 90% or more in the entire steel microstructure, the total area percentage of one or two of the martensite containing a carbide having an average particle size of 50 nm or less and the bainite containing a carbide having an average particle size of 50 nm or less is 80% or more in a region extending from the surface of the base steel sheet to a depth of ⅛ of the thickness of the base steel sheet, and the total perimeter of individual carbide particles having an average particle size of 50 nm or less in the martensite containing a carbide having an average particle size of 50 nm or less and the bainite containing a carbide having an average particle size of 50 nm or less present in the region is 50 μm/mm$^2$ or more, and the amount of diffusible hydrogen in steel is 0.20 ppm or less by mass, the tensile strength (TS) is 1,320 MPa or more, the elongation (El) is 7.0% or more, TS×El is 12,000 or more, and R/t is 4.0 or less.

The inventors have conducted intensive studies in order to solve the foregoing problems and have found that the amount of diffusible hydrogen in steel needs to be reduced to 0.20 ppm by mass or less in order to obtain excellent bendability. To reduce the amount of diffusible hydrogen in steel, fine carbides serving as hydrogen-trapping sites need to be increased in a surface layer portion of steel. To this end, it is necessary to prevent decarburization. The following have also been found: Decarburization is suppressed by adjusting the component composition of steel and shortening a residence time from the completion of finish rolling to coiling; thus, an electrolytic zinc-based coated steel sheet having excellent bendability is successfully produced. A microstructure mainly containing martensite and bainite results in high ductility and high strength. The outline of aspects of the present invention is described below.

[1] A high-ductility, high-strength electrolytic zinc-based coated steel sheet includes an electrolytic zinc-based coating on a surface of a base steel sheet, in which the base steel sheet has a component composition containing, on a percent by mass basis, C: 0.12% or more and 0.40% or less, Si: 0.001% or more and 2.0% or less, Mn: 1.7% or more and 5.0% or less, P: 0.050% or less, S: 0.0050% or less, Al: 0.010% or more and 0.20% or less, N: 0.010% or less, and Sb: 0.002% or more and 0.10% or less, the balance being Fe and incidental impurities; and a steel microstructure in which the total area percentage of one or two of martensite containing a carbide having an average particle size of 50 nm or less and bainite containing a carbide having an average particle size of 50 nm or less is 90% or more in the entire steel microstructure, the total area percentage of one or two of the martensite containing a carbide having an average particle size of 50 nm or less and the bainite containing a carbide having an average particle size of 50 nm or less is 80% or more in a region extending from the surface of the base steel sheet to a depth of ⅛ of the thickness of the base steel sheet, and the total perimeter of individual carbide particles having an average particle size of 50 nm or less in the martensite containing a carbide having an average particle size of 50 nm or less and the bainite containing a carbide having an average particle size of 50 nm or less present in the region is 50 μm/mm$^2$ or more, in which the amount of diffusible hydrogen in steel is 0.20 ppm or less by mass.

[2] In the high-ductility, high-strength electrolytic zinc-based coated steel sheet described in [1], the component composition further contains, on a percent by mass basis:

B: 0.0002% or more and less than 0.0035%.

[3] In the high-ductility, high-strength electrolytic zinc-based coated steel sheet described in [1] or [2], the component composition further contains, on a percent by mass basis, one or two selected from:

Nb: 0.002% or more and 0.08% or less, and

Ti: 0.002% or more and 0.12% or less.

[4] In the high-ductility, high-strength electrolytic zinc-based coated steel sheet described in any of [1] to [3], the component composition further contains, on a percent by mass basis, one or two selected from:

Cu: 0.005% or more and 1% or less, and

Ni: 0.01% or more and 1% or less.

[5] In the high-ductility, high-strength electrolytic zinc-based coated steel sheet described in any of [1] to [4], the component composition further contains, on a percent by mass basis, one or two or more selected from:

Cr: 0.01% or more and 1.0% or less,

Mo: 0.01% or more and less than 0.3%,

V: 0.003% or more and 0.5% or less,

Zr: 0.005% or more and 0.2% or less, and

W: 0.005% or more and 0.2% or less.

[6] In the high-ductility, high-strength electrolytic zinc-based coated steel sheet described in any of [1] to [5], the component composition further contains, on a percent by mass basis, one or two or more selected from:

Ca: 0.0002% or more and 0.0030% or less,

Ce: 0.0002% or more and 0.0030% or less,

La: 0.0002% or more and 0.0030% or less, and

Mg: 0.0002% or more and 0.0030% or less.

[7] In the high-ductility, high-strength electrolytic zinc-based coated steel sheet described in any of [1] to [6], the component composition further contains, on a percent by mass basis:

Sn: 0.002% or more and 0.1% or less.

[8] A method for producing a high-ductility, high-strength electrolytic zinc-based coated steel sheet includes:

a hot-rolling step of hot-rolling a steel slab having the component composition described in any of [1] to [7] at a slab heating temperature of 1,200° C. or higher and a finish hot-rolling temperature of 840° C. or higher, performing cooling to a primary cooling stop temperature of 700° C. or lower at an average cooling rate of 40° C./s or more in a temperature range of the finish hot-rolling temperature to 700° C., performing cooling at an average cooling rate of 2° C./s or more in a temperature range of the primary cooling stop temperature to 650° C., performing cooling to a coiling temperature of 630° C. or lower, and performing coiling;

an annealing step of heating a steel sheet after the hot-rolling step to an annealing temperature equal to or higher than an $A_{C3}$ point or performing heating to an annealing temperature equal to or higher than an $A_{C3}$ point and performing soaking, performing cooling to a cooling stop temperature of 350° C. or lower at an average cooling rate of 3° C./s or more in a temperature range of the annealing temperature to 550° C., and performing holding at a holding temperature in a temperature range of 100° C. to 200° C. for 20 to 1,500 seconds; and a coating treatment step of cooling the steel sheet after the annealing step to room temperature and subjecting the steel sheet to electrolytic zinc-based coating for an electroplating time of 300 seconds or less.

[9] The method for producing a high-ductility, high-strength electrolytic zinc-based coated steel sheet described in [8] further includes, after the hot-rolling step, a cold-rolling step of cold-rolling the steel sheet between the hot-rolling step and the annealing step.

[10] The method for producing a high-ductility, high-strength electrolytic zinc-based coated steel sheet described in [8] or [9] further includes a tempering step of holding the steel sheet after the coating treatment step in a temperature range of 250° C. or lower for a holding time t that satisfies formula (1) below:

$$(T+273)(\log t+4)\leq 2{,}700 \quad (1)$$

where in formula (1), T is a holding temperature (° C.) in the tempering step, and t is the holding time (s) in the tempering step.

Aspects of the present invention provide a high-ductility, high-strength electrolytic zinc-based coated steel sheet having excellent bendability by adjusting the component composition and the production method so as to suppress decarburization in the surface layer portion, increase the amount of fine carbides in the surface layer portion, and reduce the amount of diffusible hydrogen in steel.

The use of the high-ductility, high-strength electrolytic zinc-based coated steel sheet according to aspects of the present invention for automotive structural members can achieve both an increase in the strength and an improvement in bendability of automotive steel sheets. In other words, according to aspects of the present invention, the performance of automotive bodies is improved.

DETAILED DESCRIPTION OF EMBODIMENTS OF THE INVENTION

The inventors have conducted various studies in order to solve the foregoing problems and have found that a high-ductility, high-strength electrolytic zinc-based coated steel sheet having excellent bendability is obtained, the steel sheet having a predetermined component composition and a steel microstructure in which the total area percentage of one or two of martensite containing a carbide having an average particle size of 50 nm or less and bainite containing a carbide having an average particle size of 50 nm or less is 90% or more in the entire microstructure of the steel sheet, the total area percentage of one or two of the martensite containing a carbide having an average particle size of 50 nm or less and the bainite containing a carbide having an average particle size of 50 nm or less is 80% or more in a region extending from the surface of the base steel sheet to a depth of ⅛ of the thickness of the base steel sheet, and the total of the perimeter (total perimeter) of individual carbide particles having an average particle size of 50 nm or less in the martensite containing a carbide having an average particle size of 50 nm or less and the bainite containing a carbide having an average particle size of 50 nm or less present in the region is 50 μm/mm$^2$ or more, and the amount of diffusible hydrogen in steel is 0.20 ppm or less by mass. These findings have led to the completion of the present invention.

Embodiments of the present invention will be described below. The present invention is not limited to the embodiments described below.

A high-ductility, high-strength electrolytic zinc-based coated steel sheet according to aspects of the present invention includes a layer of electrolytic zinc-based coating on a surface of a steel sheet serving as a base (base steel sheet).

The component composition of the base steel sheet (hereinafter, also referred to simply as a "steel sheet") according to aspects of the present invention will first be described. In the description of the component composition, each component content is expressed in units of "%" that indicates "% by mass".

C: 0.12% or More and 0.40% or Less

C is an element that improves hardenability, and is incorporated from the viewpoint of achieving a predetermined area percentage of martensite and/or bainite and increasing the strength of martensite and bainite to ensure TS 1,320 MPa. Finely dispersed carbides trap hydrogen in steel to reduce the amount of diffusible hydrogen in the steel, thereby improving the bendability. When the C content is less than 0.12%, fine carbides in the surface layer portion of the steel cannot be ensured; thus, excellent bendability cannot be maintained. Accordingly, the C content is 0.12% or more. From the viewpoint of achieving higher TS, such as TS 1,470 MPa, the C content is preferably more than 0.16%, more preferably 0.18% or more. When the C content is more than 0.40%, carbides in martensite and bainite coarsen. The presence of the coarse carbides in the surface layer portion causes the coarse carbides to act as the starting points of bent cracks, thereby deteriorating the bendability. Accordingly, the C content is 0.40% or less. The C content is preferably 0.30% or less, more preferably 0.25% or less.

Si: 0.001% or More and 2.0% or Less

Si is an element that contributes to strengthening by solid-solution strengthening. When a steel sheet is held in a temperature range of 200° C. or higher, Si suppresses the excessive formation of coarse carbides to contribute to an improvement in bendability. Si also reduces the segregation of Mn in the middle portion of the sheet in the thickness direction to contribute to the suppression of the formation of MnS. Additionally, Si contributes to the suppression of decarburization and deboronization due to the oxidation of the surface layer portion of the steel sheet during continuous annealing. To sufficiently provide the effects described above, the Si content is 0.001% or more. The Si content is preferably 0.003% or more, more preferably 0.005% or more. An excessively high Si content results in the extension of the segregation in the thickness direction to easily form coarse MnS in the thickness direction, thereby deteriorating the bendability. Additionally, the formation of carbides is suppressed; thus, the absence of fine carbides increases the amount of diffusible hydrogen at the surface layer in the steel, thereby deteriorating the bendability. Accordingly, the Si content is 2.0% or less. The Si content is preferably 1.5% or less, more preferably 1.2% or less.

Mn: 1.7% or More and 5.0% or Less

Mn is incorporated in order to improve the hardenability of the steel and obtain a predetermined area percentage of martensite and/or bainite. A Mn content of less than 1.7% results in the formation of ferrite in the surface layer portion of the steel sheet to decrease the strength. Additionally, the absence of fine carbides in the surface layer portion increases the amount of diffusible hydrogen in the surface layer portion of the steel to deteriorate the bendability. Accordingly, Mn needs to be contained in an amount of 1.7% or more. The Mn content is preferably 2.4% or more, more preferably 2.8% or more. An excessively high Mn content may result in the increase of coarse carbides in the surface layer portion to significantly deteriorate the bendability. Accordingly, the Mn content is 5.0% or less. The Mn content is preferably 4.8% or less, more preferably 4.4% or less.

P: 0.050% or Less

P is an element that strengthens steel. At a high P content, the occurrence of cracking is promoted. Thus, even in the case of a small amount of diffusible hydrogen in the steel, the bendability is significantly deteriorated. Accordingly, the P content is 0.050% or less. The P content is preferably 0.030% or less, more preferably 0.010% or less. The lower limit of the P content is not particularly limited. Currently, the industrially feasible lower limit is about 0.003%.

S: 0.0050% or Less

S significantly adversely affects the bendability through the formation of inclusions, such as MnS, TiS, and Ti(C,S). To reduce the harmful effect of these inclusions, the S content needs to be 0.0050% or less. The S content is preferably 0.0020% or less, more preferably 0.0010% or less, even more preferably 0.0005% or less. The lower limit of the S content is not particularly limited. Currently, the industrially feasible lower limit is about 0.0002%.

Al: 0.010% or More and 0.20% or Less

Al is added in order to sufficiently perform deoxidation to reduce coarse inclusions in the steel. The effect is provided at 0.010% or more. The Al content is preferably 0.015% or more. At an Al content of more than 0.20%, carbides mainly containing Fe, such as cementite, formed during coiling after hot rolling do not easily dissolve in an annealing step; thus, coarse inclusions and coarse carbides are formed to deteriorate the bendability. Accordingly, the Al content is 0.20% or less. The Al content is preferably 0.17% or less, more preferably 0.15% or less.

N: 0.010% or Less

N is an element that forms coarse nitride- and carbonitride-based inclusions, such as TiN, (Nb,Ti) (C,N), AlN, in the steel, and deteriorates the bendability through the formation of these inclusions. To prevent the deterioration of the bendability, the N content needs to be 0.010% or less. The N content is preferably 0.007% or less, more preferably 0.005% or less. The lower limit of the N content is not particularly limited. Currently, the industrially feasible lower limit is about 0.0006%.

Sb: 0.002% or More and 0.10% or Less

Sb suppresses the oxidation and nitriding of the surface layer portion of the steel sheet to suppress decarburization due to the oxidation and nitriding in the surface layer portion of the steel sheet. The suppression of decarburization suppresses the formation of ferrite in the surface layer portion of the steel sheet, thereby contributing to an increase in strength. Additionally, fine carbides can be provided in the surface layer portion of the steel to reduce the amount of diffusible hydrogen in the surface layer portion of the steel. From this point of view, Sb needs to be contained in an amount of 0.002% or more. The Sb content is preferably 0.004% or more, more preferably 0.007% or more. When Sb is contained in an amount of more than 0.10%, Sb segregates at prior y grain boundaries to promote the occurrence of cracking, thereby deteriorating the bendability. Accordingly, the Sb content is 0.10% or less. The Sb content is preferably 0.08% or less, more preferably 0.06% or less.

The steel sheet according to aspects of the present invention has a component composition having the foregoing components, the balance being Fe (iron) and incidental impurities. The steel sheet according to aspects of the present invention preferably has the component composition, having the foregoing components and the balance Fe and incidental impurities. The steel sheet according to aspects of the present invention may further contain the following components as optional components. In the case where the optional components are contained in amounts of less than the lower limits, the components are contained as incidental impurities.

B: 0.0002% or More and Less Than 0.0035%

B is an element that improves the hardenability of steel, and has the advantage that martensite and bainite having predetermined area percentages are formed even in the case of a low Mn content. To provide the effects of B, B is preferably contained in an amount of 0.0002% or more. The B content is more preferably 0.0005% or more, even more preferably 0.0007% or more. From the viewpoint of immobilizing N, B is preferably added in combination with 0.002% or more of Ti. A B content of 0.0035% or more results in a decrease in dissolution rate of cementite during annealing to leave carbides mainly containing Fe, such as undissolved cementite. This leads to the formation of coarse inclusions and carbides, thereby deteriorating the bendability. Accordingly, the B content is preferably less than 0.0035%. The B content is more preferably 0.0030% or less, even more preferably 0.0025% or less.

One or Two Selected from Nb: 0.002% or More and 0.08% or Less and Ti: 0.002% or More and 0.12% or Less Nb and Ti contribute to an increase in strength through a reduction in the size of prior y grains. Fine Nb and Ti carbides formed serve as hydrogen-trapping sites to reduce the amount of diffusible hydrogen in the steel, thereby improving the bendability. From this point of view, each of Nb and Ti is preferably contained in an amount of 0.002% or more. Each of the Nb content and the Ti content is more preferably 0.003% or more, even more preferably 0.005% or more. When large amounts of Nb and Ti are contained, coarse Nb-based precipitates remaining undissolved, such as NbN, Nb(C,N), and (Nb,Ti) (C,N), and coarse Ti-based precipitates, such as TiN, Ti(C,N), Ti(C,S), and TiS, are increased during heating of the slab in the hot-rolling step to deteriorate the bendability. Accordingly, Nb is preferably contained in an amount of 0.08% or less. The Nb content is more preferably 0.06% or less, even more preferably 0.04% or less. Ti is preferably contained in an amount of 0.12% or less. The Ti content is more preferably 0.10% or less, even more preferably 0.08% or less.

One or two Selected from Cu: 0.005% or More and 1% or Less and Ni: 0.01% or More and 1% or Less Cu and Ni are effective in improving the corrosion resistance in an environment in which automobiles are used and suppressing hydrogen entry into the steel sheet by allowing corrosion products to cover the surfaces of the steel sheet. From this point of view, Cu is preferably contained in an amount of 0.005% or more. Ni is preferably contained in an amount of 0.01% or more. From the viewpoint of improving the bendability, each of Cu and Ni is more preferably contained in an amount of 0.05% or more, even more preferably 0.08% or more. However, excessively large amounts of Cu and Ni lead to the occurrence of surface defects to deteriorate coatability and chemical conversion treatability. Accordingly, each of the Cu content and the Ni content is preferably 1% or less. Each of the Cu content and the Ni content is more preferably 0.8% or less, even more preferably 0.6% or less.

One or Two or More Selected from Cr: 0.01% or More and 1.0% or Less, Mo: 0.01% or More and Less Than 0.3%, V: 0.003% or More and 0.5% or Less, Zr: 0.005% or More and 0.2% or Less, and W: 0.005% or More and 0.2% or Less Cr, Mo, and V may be incorporated in order to improve the hardenability of steel. To provide the effect, each of Cr and Mo is preferably contained in an amount of 0.01% or more. Each of the Cr content and the Mo content is more preferably 0.02% or more, even more preferably 0.03% or more. V is preferably contained in an amount of 0.003% or more. The V content is more preferably 0.005% or more, even more preferably 0.007% or more. However, an excessively large amount of any of Cr, Mo, and V leads to coarsening of carbides, thereby deteriorating the bendability. Accordingly, the Cr content is preferably 1.0% or less. The Cr content is more preferably 0.4% or less, even more preferably 0.2% or less. The Mo content is preferably less than 0.3%. The Mo content is more preferably 0.2% or less, even more preferably 0.1% or less. The V content is preferably 0.5% or less. The V content is more preferably 0.4% or less, even more preferably 0.3% or less.

Zr and W contribute to an increase in strength through a reduction in the size of prior y grains. From this point of view, each of Zr and W is preferably contained in an amount of 0.005% or more. Each of the Zr content and the W content is more preferably 0.006% or more, even more preferably 0.007% or more. However, when large amounts of Zr and W are contained, coarse precipitates remaining undissolved are increased during heating of the slab in the hot-rolling step to deteriorate the bendability. Accordingly, each of Zr and W is preferably contained in an amount of 0.2% or less. Each of the Zr content and the W content is more preferably 0.15% or less, even more preferably 0.1% or less.

One or Two or More Selected from Ca: 0.0002% or More and 0.0030% or Less, Ce: 0.0002% or More and 0.0030% or Less, La: 0.0002% or More and 0.0030% or Less, and Mg: 0.0002% or More and 0.0030% or Less Ca, Ce, and La immobilize S in the form of sulfide, serve as hydrogen-trapping sites in steel, and reduce the amount of diffusible hydrogen in the steel to contribute to an improvement in bendability. For this reason, each of the Ca content, the Ce content, and the La content is preferably 0.0002% or more. Each of the Ca content, the Ce content, and the La content is more preferably 0.0003% or more, even more preferably 0.0005% or more. The addition of large amounts of Ca, Ce, and La coarsens sulfides to deteriorate the bendability. Accordingly, each of the Ca content, the Ce content, and the La content is preferably 0.0030% or less. Each of the Ca content, the Ce content, and the La content is more preferably 0.0020% or less, even more preferably 0.0010% or less.

Mg immobilizes 0 in the form of MgO, serves as a hydrogen-trapping site in steel, and reduces the amount of diffusible hydrogen in the steel to contribute to an improvement in bendability. Accordingly, the Mg content is preferably 0.0002% or more. The Mg content is more preferably 0.0003% or more, even more preferably 0.0005% or more. The addition of a large amount of Mg coarsens MgO to deteriorate the bendability. Thus, the Mg content is preferably 0.0030% or less. The Mg content is more preferably 0.0020% or less, even more preferably 0.0010% or less.

Sn: 0.002% or More and 0.1% or Less

Sn suppresses the oxidation and nitriding of the surface layer portion of the steel sheet to suppress decarburization due to the oxidation and nitriding in the surface layer portion of the steel sheet. The suppression of decarburization suppresses the formation of ferrite in the surface layer portion of the steel sheet, thereby contributing to an increase in strength. Additionally, fine carbides can be provided in the surface layer portion of the steel to reduce the amount of diffusible hydrogen in the surface layer portion of the steel. From this point of view, Sn is preferably contained in an amount of 0.002% or more. The Sn content is more preferably 0.003% or more, even more preferably 0.004% or more. When Sn is contained in an amount of more than 0.1%, Sn segregates at prior y grain boundaries to promote the occurrence of cracking, thereby deteriorating the bendability. Accordingly, the Sn is contained in an amount of 0.1% or less. The Sn content is more preferably 0.08% or less, even more preferably 0.06% or less.

Amount of Diffusible Hydrogen in Steel of 0.20 ppm or Less by Mass

The amount of diffusible hydrogen in accordance with aspects of the present invention indicates the cumulative amount of hydrogen released from a heating start temperature (25° C.) to 200° C. when heating is performed at a rate of temperature increase of 200° C./h with a thermal desorption spectroscopy system immediately after removal of the coating from the electrolytic zinc-based coated steel sheet. When the amount of diffusible hydrogen in the steel is more than 0.20 ppm by mass, cracking is promoted during bending to deteriorate the bendability. Accordingly, the amount of diffusible hydrogen in the steel is 0.20 ppm or less by mass. The amount of diffusible hydrogen in the steel is preferably 0.17 ppm or less by mass, more preferably 0.13 ppm or less by mass. The lower limit of the amount of diffusible hydrogen in the steel is not particularly limited and may be 0 ppm by mass. As the value of the amount of diffusible hydrogen in the steel, a value obtained by a measurement method described in Examples is used. In accordance with aspects of the present invention, the amount of diffusible hydrogen in the steel needs to be 0.20 ppm or less by mass before forming or welding the steel sheet. Regarding a product (member) after forming or welding the steel sheet, in the case where a sample is cut out from the product placed in a common use environment and then the amount of diffusible hydrogen in the steel is measured and found to be 0.20 ppm or less by mass, the amount of diffusible hydrogen in the steel can be regarded as 0.20 ppm or less by mass even before forming or welding.

The microstructure of the steel sheet according to aspects of the present invention will be described below.

Total Area Percentage of One or Two of Martensite Containing Carbide Having Average Particle Size of 50 nm or Less and Bainite Containing Carbide Having Average Particle Size of 50 nm or Less Is 90% or More To obtain high strength of TS 1,320 MPa, the total area percentage of one or two of martensite containing a carbide having an average particle size of 50 nm or less and bainite containing a carbide having an average particle size of 50 nm or less is 90% or more with respect to the entire steel microstructure. At less than this value, ferrite is increased to deteriorate the strength. The total area percentage of the martensite and the bainite may be 100% with respect to the entire steel microstructure. The area percentage of one of the martensite and the bainite may be in the above range, and the total area percentage of both of them may be in the above range. The martensite is defined as the total of as-quenched martensite and tempered martensite. In accordance with aspects of the present invention, martensite refers to a hard microstructure formed from austenite at a low temperature (martensitic transformation temperature or lower). Tempered martensite refers to a microstructure that has been subjected to tempering at the time of reheating martensite. Bainite refers to a hard microstructure in which fine carbides are dispersed in acicular or plate-like ferrite and which is formed from austenite at a relatively low temperature (martensite transformation temperature or higher).

The residual microstructure other than the martensite or the bainite includes, for example, ferrite, pearlite, and retained austenite. When the total amount thereof is, by area percentage, 10% or less, the residual microstructure is allowable. The area percentage of the residual microstructure may be 0%. In accordance with aspects of the present invention, ferrite refers to a microstructure that is formed by transformation from austenite at a relatively high temperature and that is grains with a bcc lattice. Pearlite refers to a layered microstructure composed of layers of ferrite and cementite. Retained austenite refers to austenite that does not transform to martensite when a martensitic transformation temperature is equal to or lower than room temperature. In accordance with aspects of the present invention, the area percentage of each phase in the steel microstructure is determined by a method described in Examples.

Total Area Percentage of One or Two of Martensite Containing Carbide Having Average Particle Size of 50 nm or Less and Bainite Containing Carbide Having Average Particle Size of 50 nm or Less in Region Extending from Surface of Base Steel Sheet to Depth of ⅛ of Thickness of Base Steel Sheet Is 80% or More Cracking due to bending occurs from a surface layer in a ridge line portion formed by bending of a plated steel sheet; thus, the microstructure of the surface layer portion of the steel sheet is significantly important. In accordance with aspects of the present invention, the use of fine carbides in the surface layer portion as a hydrogen-trapping site reduces the amount of diffusible hydrogen in the vicinity of the surface layer of the steel to improve the bendability. Accordingly, in the case where the total area percentage of one or two of the martensite containing a carbide having an average particle size of 50 nm or less and the bainite containing a carbide having an average particle size of 50 nm or less in a region extending from a surface of the base steel sheet to a depth of ⅛ of the thickness of the base steel sheet is 80% or more, desired bendability can be ensured. The area percentage is preferably 82% or more, more preferably 85% or more. The upper limit of the area percentage is not particularly limited and may be 100%. In the region described above, one of the martensite and the bainite may be in the above range, and the total area percentage of both of them may be in the above range.

Total Perimeter of Individual Carbide Particles Having Average Particle Size of 50 nm or Less in Martensite Containing Carbide Having Average Particle Size of 50 nm or Less and Bainite Containing Carbide Having Average Particle Size of 50 nm or Less Present in Region Extending from Surface of Base Steel Sheet to Depth of ⅛ of Thickness of Base Steel Sheet Is 50 $\mu m/mm^2$ or More The amount of diffusible hydrogen in the surface layer portion of the steel is reduced by an increase in the surface area of fine carbide particles present in the vicinity of the surface layer. Thus, the increase in the surface area of fine carbide particles is important. In accordance with aspects of the present invention, as an index of the surface area of fine carbide particles, perimeters of fine carbide particles are used. The total perimeter of carbide particles having an average particle size of 50 nm or less in martensite containing a carbide having an average particle size of 50 nm or less and bainite containing a carbide having an average particle size of 50 nm or less present in a region extending from a surface of the base steel sheet to a depth of ⅛ of the thickness of the base steel sheet is 50 $\mu m/mm^2$ or more (50 μm or more per 1 $mm^2$). The total perimeter of the carbide particles is preferably 55 $\mu m/mm^2$ or more, more preferably 60 $\mu m/mm^2$ or more. In accordance with aspects of the present invention, the total perimeter of the carbide particles is determined by a method described in Examples.

The high-ductility, high-strength electrolytic zinc-based coated steel sheet according to aspects of the present invention includes an electrolytic zinc-based coating on a surface of a steel sheet serving as a base (base steel sheet). The type of the zinc-based coating is not particularly limited and may be, for example, a zinc coating (pure Zn) or a zinc alloy coating (e.g., Zn—Ni, Zn—Fe, Zn—Mn, Zn—Cr, or Zn—Co). The coating weight of the electrolytic zinc-based coating is preferably 25 $g/m^2$ or more per one surface from the viewpoint of improving corrosion resistance. The coating weight of the electrolytic zinc-based coating is preferably 50 $g/m^2$ or less per one surface from the viewpoint of not deteriorating the bendability. The high-ductility, high-strength electrolytic zinc-based coated steel sheet according to aspects of the present invention may include the electrolytic zinc-based coating on one surface of the base steel sheet or may include the electrolytic zinc-based coating on each surface of the base steel sheet. The high-ductility, high-strength electrolytic zinc-based coated steel sheet according to aspects of the present invention preferably includes the electrolytic zinc-based coating on each surface of the base steel sheet when used for automobiles.

The high-ductility, high-strength electrolytic zinc-based coated steel sheet according to aspects of the present invention has a tensile strength of 1,320 MPa or more. The tensile strength is preferably 1,400 MPa or more, more preferably 1,470 MPa or more, even more preferably 1,600 MPa or more. The upper limit of the tensile strength is preferably, but not necessarily, 2,200 MPa or less from the viewpoint of easily achieving a balance with other characteristics.

The high-ductility, high-strength electrolytic zinc-based coated steel sheet according to aspects of the present invention has an elongation (El) of 7.0% or more. The elongation is preferably 7.2% or more, more preferably 7.5% or more. Additionally, TS (MPa)×El (%) is 12,000 or more. TS×El is preferably 13,000 or more, more preferably 13,500 or more. Each of the tensile strength (TS) and the elongation (El) is measured by a method described in Examples.

The limit bending radius/thickness (R/t) of the high-ductility, high-strength electrolytic zinc-based coated steel sheet according to aspects of the present invention is 4.0 or less in a predetermined bending test (bending test described in Examples). R/t is preferably 3.8 or less, more preferably 3.6 or less.

A method for producing a high-ductility, high-strength electrolytic zinc-based coated steel sheet according to an embodiment of the present invention will be described below.

The method for producing a high-ductility, high-strength electrolytic zinc-based coated steel sheet according to an embodiment of the present invention includes at least a hot-rolling step, an annealing step, and a coating treatment step. Additionally, a cold-rolling step may be included between the hot-rolling step and the annealing step. A tempering step may be included after the coating treatment step. These steps will be described below. A temperature described below refers to the surface temperature of a slab, a steel sheet, or the like.

(Hot-Rolling Step)

Slab Heating Temperature

A steel slab having the component composition described above is subjected to hot rolling. The use of a slab heating temperature of 1,200° C. or higher promotes the dissolution of sulfide and reduces the segregation of Mn to reduce the amounts of coarse inclusions described above, thereby improving the bendability. For this reason, the slab heating temperature is 1,200° C. or higher. The slab heating temperature is more preferably 1,230° C. or higher, even more preferably 1,250° C. or higher. For example, the heating rate during heating of the slab may be 5 to 15° C./min, and the slab soaking time may be 30 to 100 minutes.

Finish Hot-Rolling Temperature

The finish hot-rolling temperature needs to be 840° C. or higher. At a finish hot-rolling temperature of lower than 840° C., it takes time to reduce the temperature. This may form inclusions to deteriorate the bendability and deteriorate the quality of the inside of the steel sheet. Additionally, decarburization at a surface layer decreases the area percentages of bainite and martensite containing carbides in the surface layer portion of the steel to decrease fine carbides serving as hydrogen-trapping sites in the vicinity of the surface layer, thereby making it difficult to ensure desired bendability. Accordingly, the finish hot-rolling temperature needs to be 840° C. or higher. The finish hot-rolling temperature is preferably 860° C. or higher. The upper limit of the finish hot-rolling temperature is preferably, but not necessarily, 950° C. or lower because a difficulty lies in cooling to a coiling temperature described below. The finish hot-rolling temperature is more preferably 920° C. or lower.

After the completion of the finish hot rolling, cooling is performed to a primary cooling stop temperature of 700° C. or lower at an average cooling rate of 40° C./s or more in a temperature range of the finish hot-rolling temperature to 700° C. A low cooling rate results in the formation of inclusions. An increase in the size of the inclusions deteriorates the bendability. Decarburization at the surface layer decreases area percentages of martensite and bainite containing carbides in the surface layer portion of the steel to decrease fine carbides serving as hydrogen-trapping sites in the vicinity of the surface layer, thereby making it difficult to ensure desired bendability. Accordingly, after the completion of the finish hot rolling, the average cooling rate is 40° C./s or more from the finish hot-rolling temperature to 700° C. The average cooling rate is preferably 50° C./s or more. The upper limit of the average cooling rate is preferably, but not necessarily, about 250° C./s. The primary cooling stop temperature is 700° C. or lower. At a primary cooling stop temperature of higher than 700° C., carbides are easily formed down to 700° C. The coarsening of the carbides deteriorates the bendability. The lower limit of the primary cooling stop temperature is not particularly limited. At a primary cooling stop temperature of 650° C. or lower, the effect of rapid cooling on the suppression of carbide formation is decreased. Thus, the primary cooling stop temperature is preferably higher than 650° C.

After that, cooling is performed at an average cooling rate of 2° C./s or more in a temperature range of the primary cooling stop temperature to 650° C., and then cooling is performed to a coiling temperature of 630° C. or lower. A low cooling rate to 650° C. results in the formation of inclusions. An increase in the size of the inclusions deteriorates the bendability. Decarburization at the surface layer decreases area percentages of martensite and bainite containing carbides in the surface layer portion of the steel to decrease fine carbides serving as hydrogen-trapping sites in the vicinity of the surface layer, thereby making it difficult to ensure desired bendability. Accordingly, as described above, after cooling is performed to a primary cooling stop temperature of 700° C. or lower at an average cooling rate of 40° C./s or more in the temperature range down to 700° C., the average cooling rate is 2° C./s or more in the temperature range of the primary cooling stop temperature to 650° C. The average cooling rate is preferably 3° C./s or more, more preferably 5° C./s. The average cooling rate from 650° C. to the coiling temperature is preferably, but not necessarily, 0.1° C./s or more and 100° C./s or less.

The coiling temperature is 630° C. or lower. A coiling temperature of higher than 630° C. may result in decarburization at the surface of base steel to lead to a difference in microstructure between the inside and the surface of the steel sheet, causing a nonuniformity in alloy concentration. Additionally, decarburization at the surface layer decreases area percentages of martensite and bainite containing carbides in the surface layer portion of the steel to decrease fine carbides serving as hydrogen-trapping sites in the vicinity of the surface layer, thereby making it difficult to ensure desired bendability. Accordingly, the coiling temperature is 630° C. or lower. The coiling temperature is preferably 600° C. or lower. The lower limit of the coiling temperature is not particularly limited. To prevent a decrease in cold rollability when cold rolling is performed, the coiling temperature is preferably 500° C. or higher.

Cold-Rolling Step

After the hot-rolling step, a cold-rolling step may be performed. In the case where the cold-rolling step is performed, in the cold-rolling step, the steel sheet (hot-rolled steel sheet) coiled in the hot-rolled step is subjected to pickling and then cold rolling to produce a cold-rolled steel sheet. The conditions of the pickling are not particularly limited. The rolling reduction is not particularly limited. At a rolling reduction of less than 20%, the surfaces may have poor flatness to lead to a nonuniform microstructure. Thus, the rolling reduction is preferably 20% or more. The cold-rolling step may be omitted as long as the microstructure and the mechanical properties satisfy the requirements of the present invention.

(Annealing Step)

The steel sheet that has been subjected to the hot-rolling step or the cold-rolling step subsequent to the hot-rolling step is heated to an annealing temperature equal to or higher than an $A_{C3}$ point. An annealing temperature of lower than the $A_{C3}$ point results in the formation of ferrite in the microstructure to fail to obtain desired strength. Accordingly, the annealing temperature is the $A_{C3}$ point or higher. The annealing temperature is preferably the $A_{C3}$ point+10° C. or higher, more preferably the $A_{C3}$ point+20° C. or higher. The upper limit of the annealing temperature is not particularly limited. From the viewpoint of suppressing the coarsening of austenite to prevent the deterioration of the bendability, the annealing temperature is preferably 900° C. or lower. The atmosphere during annealing is not particularly limited. From the viewpoint of preventing decarburization in the surface layer portion, the dew point is preferably −50° C. or higher and −5° C. or lower.

The $A_{C3}$ point (° C.) used here is calculated from the following formula. In the formula, each (% symbol of element) refers to the amount of the corresponding element contained (% by mass).

$$A_{C3}\text{ point}=910-203(\%\ C)^{1/2}+45(\%\ Si)-30(\%\ Mn)-20(\%\ Cu)-15(\%\ Ni)+11(\%\ Cr)+32(\%\ Mo)+104(\%\ V)+400(\%\ Ti)+460(\%\ Al)$$

After heating is performed to the annealing temperature equal to or higher than the $A_{C3}$ point, cooling is performed to a cooling stop temperature of 350° C. or lower at an average cooling rate of 3° C./s or more in a temperature range of the annealing temperature to 550° C., and holding is performed at a holding temperature in a temperature range of 100° C. to 200° C. for 20 to 1,500 seconds. After heating to the annealing temperature equal to or higher than the $A_{C3}$ point, soaking may be performed at the annealing temperature. The soaking time here is preferably, but not necessarily, 10 seconds or more and 300 seconds or less, more preferably 15 seconds or more and 250 seconds or less. An average cooling rate of less than 3° C./s in the temperature range of the annealing temperature to 550° C. leads to excessive formation of ferrite to make it difficult to obtain desired strength. Additionally, the formation of ferrite in the surface layer portion makes it difficult to increase the fractions of the martensite and bainite containing carbides in the vicinity of the surface layer, thereby deteriorating the bendability. Accordingly, the average cooling rate in the temperature range of the annealing temperature to 550° C. is 3° C./s or more, preferably 5° C./s or more, more preferably 10° C./s or more.

The cooling stop temperature is 350° C. or lower. A cooling stop temperature of higher than 350° C. results in the formation of bainite containing coarse carbides to decrease the amount of fine carbides in the surface layer portion of the steel, thereby deteriorating the bendability.

The average cooling rate is defined by (the cooling start temperature−the cooling stop temperature)/the cooling time from the cooling start temperature to the cooling stop temperature, unless otherwise specified.

Then holding is performed at a holding temperature in the temperature range of 100° C. to 200° C. for 20 to 1,500 seconds. The carbides distributed in the bainite are carbides formed during the holding in the low temperature range after quenching and serve as hydrogen-trapping sites to trap hydrogen, and can prevent the deterioration of the bendability. When the holding temperature is lower than 100° C. or when the holding time is less than 20 seconds, bainite is not formed, and as-quenched martensite containing no carbide is formed. Thus, the amount of fine carbides in the surface layer portion of the steel is decreased to fail to provide the above effect. When the holding temperature is higher than 200° C. or when the holding time is more than 1,500 seconds, decarburization occurs, and coarse carbides are formed in the bainite, thereby deteriorating the bendability. The holding temperature is preferably 120° C. or higher. The holding temperature is preferably 180° C. or lower. The holding time is preferably 50 seconds or more. The holding time is preferably 1,000 seconds or less.

After the annealing step, cooling is performed to room temperature. The cooling rate at this time is not particularly limited. Down to 50° C., the average cooling rate is preferably 1° C./s or more. The term "room temperature" indicates, for example, 10° C. to 30° C.

(Coating Treatment Step)

After cooling to room temperature, the steel sheet is subjected to electrolytic zinc-based coating. The type of the electrolytic zinc-based coating may be, but is not particularly limited to, any of pure Zn, Zn—Ni, Zn—Fe, Zn—Mn, Zn—Cr, Zn—Co, and so forth. To suppress the entry of hydrogen into the steel and to achieve the amount of diffusible hydrogen in the steel of the electrolytic zinc-based coated steel sheet to 0.20 ppm or less by mass, the electroplating time is important. At an electroplating time of more than 300 seconds, the steel sheet is immersed in an acid for a long time; thus, the amount of diffusible hydrogen in the steel is more than 0.20 ppm by mass, thereby deteriorating the bendability. Accordingly, the electroplating time is 300 seconds or less. The electroplating time is preferably 280 seconds or less, more preferably 250 seconds or less.

The steel sheet after the coating treatment step (electrolytic zinc-based coated steel sheet) may be subjected to the tempering step. The amount of diffusible hydrogen in the steel can be reduced through the tempering step to further enhance the bendability. The tempering step is preferably a step of holding the steel sheet after the coating treatment step in a temperature range of 250° C. or lower for a holding time t that satisfies formula (1) below:

$$(T+273)(\log t+4)\leq 2{,}700 \quad (1)$$

where in formula (1), T is the holding temperature (° C.) in the tempering step, and t is the holding time (seconds) in the tempering step.

In the production method according to the embodiment described above, the high-ductility, high-strength electrolytic zinc-based coated steel sheet having excellent bendability can be produced by controlling the production condition of the base steel sheet before the coating treatment step and the coating treatment conditions so as to form fine carbides in the surface layer portion of the steel and use the fine carbides as hydrogen-trapping sites to reduce the amount of diffusible hydrogen in the steel.

The hot-rolled steel sheet after the hot-rolling step may be subjected to heat treatment for softening the microstructure. After the coating treatment step, temper rolling may be performed for shape adjustment.

EXAMPLES

The present invention will be specifically described below with reference to Examples.

1. Production of Steel Sheet for Evaluation

Molten steels having component compositions given in Table 1, the balance being Fe and incidental impurities, were produced with a vacuum melting furnace. Each steel was subjected to blooming into a steel slab having a thickness of 27 mm. The resulting steel slab was hot-rolled into a hot-rolled steel sheet having a thickness of 4.0 mm (hot-rolling step). Regarding samples to be subjected to cold rolling, the hot-rolled steel sheets were processed by grinding into a thickness of 3.2 mm and then cold-rolled at rolling reductions given in Tables 2-1 to 2-4 into cold-rolled steel sheets having a thickness of 1.4 mm (cold-rolling step). In Table 2-1, samples in which numerical values of the rolling reduction in the cold rolling are not described were not subjected to cold rolling. The hot-rolled steel sheets and the cold-rolled steel sheets produced as described above were subjected to heat treatment (annealing step) and coating (coating treatment step) under conditions given in Tables 2-1 to 2-4 to produce electrolytic zinc-based coated steel sheets. Blanks in Table 1 presenting the component composition indicate that the components are intentionally not added, and the blanks also include the case where the components are not contained (0% by mass) and the case where the components are incidentally contained. Some samples were subjected to the tempering step. In Tables 2-1 to 2-4, tempering condition cells that are blank indicate that no tempering step was performed.

In the coating treatment step, in the case of pure Zn coating, an electroplating solution prepared by adding 440 g/L of zinc sulfate heptahydrate to deionized water and adjusting the pH to 2.0 with sulfuric acid was used. For Zn—Ni coating, an electroplating solution prepared by adding 150 g/L of zinc sulfate heptahydrate and 350 g/L of nickel sulfate hexahydrate to deionized water and adjusting the pH to 1.3 with sulfuric acid was used. In the case of Zn—Fe coating, an electroplating solution prepared by adding 50 g/L of zinc sulfate heptahydrate and 350 g/L of iron sulfate to deionized water and adjusting the pH to 2.0 with sulfuric acid was used. Inductively coupled plasma (ICP) analysis of the coatings revealed that the alloy compositions of the coatings were 100% Zn, Zn-13% Ni, and Zn-46% Fe. The coating weight of each electrolytic zinc-based coating was 25 to 50 g/m$^2$ per one surface. Specifically, the coating composed of 100%-Zn had a coating weight of 33 g/m$^2$ per one surface. The coating composed of Zn-13% Ni had a coating weight of 27 g/m$^2$ per one surface. The coating composed of Zn-46% Fe had a coating weight of 27 g/m$^2$ per one surface. These electrolytic zinc-based coatings were formed on both surfaces of the steel sheets.

TABLE 1

| Steel grade | Component composition (% by mass) C | Si | Mn | P | S | Al | N | Sb | B | Nb | Ti | Cu | Ni |
|---|---|---|---|---|---|---|---|---|---|---|---|---|---|
| A | 0.24 | 1.0 | 3.0 | 0.007 | 0.0008 | 0.051 | 0.0021 | 0.01 | | | | | |
| B | 0.17 | 1.1 | 2.9 | 0.008 | 0.0003 | 0.068 | 0.0048 | 0.01 | | | | | |
| C | 0.13 | 1.0 | 3.0 | 0.008 | 0.0005 | 0.080 | 0.0021 | 0.02 | | | | | |
| D | 0.27 | 1.2 | 2.9 | 0.018 | 0.0002 | 0.021 | 0.0043 | 0.01 | | | | | |
| E | 0.35 | 1.2 | 3.0 | 0.010 | 0.0010 | 0.077 | 0.0043 | 0.01 | | | | | |
| F | 0.24 | 0.002 | 3.5 | 0.010 | 0.0010 | 0.049 | 0.0058 | 0.04 | | | | | |
| G | 0.22 | 1.7 | 3.4 | 0.007 | 0.0004 | 0.036 | 0.0014 | 0.01 | | | | | |
| H | 0.22 | 0.9 | 1.8 | 0.007 | 0.0010 | 0.078 | 0.0034 | 0.02 | | | | | |
| I | 0.21 | 0.8 | 2.5 | 0.006 | 0.0007 | 0.096 | 0.0046 | 0.03 | | | | | |
| J | 0.23 | 0.9 | 4.9 | 0.025 | 0.0002 | 0.092 | 0.0028 | 0.01 | | | | | |
| K | 0.19 | 1.0 | 3.5 | 0.009 | 0.0009 | 0.026 | 0.0031 | 0.005 | | | | | |
| L | 0.22 | 0.9 | 3.7 | 0.016 | 0.0004 | 0.039 | 0.0028 | 0.003 | | | | | |
| M | 0.23 | 0.8 | 3.4 | 0.005 | 0.0004 | 0.050 | 0.0015 | 0.07 | | | | | |
| N | 0.22 | 0.8 | 3.5 | 0.006 | 0.0010 | 0.066 | 0.0053 | 0.09 | | | | | |
| O | 0.23 | 1.1 | 3.6 | 0.038 | 0.0006 | 0.051 | 0.0040 | 0.01 | | | | | |
| P | 0.19 | 0.1 | 2.9 | 0.006 | 0.0002 | 0.062 | 0.0027 | 0.01 | 0.0020 | | | | |
| Q | 0.24 | 0.8 | 3.1 | 0.009 | 0.0002 | 0.063 | 0.0051 | 0.05 | | 0.0200 | | | |
| R | 0.20 | 0.1 | 3.1 | 0.007 | 0.0004 | 0.038 | 0.0051 | 0.01 | | | 0.017 | | |
| S | 0.25 | 0.1 | 2.8 | 0.006 | 0.0003 | 0.040 | 0.0037 | 0.01 | 0.0015 | 0.0150 | 0.015 | | |
| T | 0.18 | 0.8 | 3.4 | 0.017 | 0.0005 | 0.034 | 0.0019 | 0.06 | | | | 0.12 | |
| U | 0.21 | 0.2 | 3.5 | 0.009 | 0.0003 | 0.096 | 0.0060 | 0.01 | | | | 0.15 | 0.04 |
| V | 0.20 | 0.6 | 3.4 | 0.025 | 0.0010 | 0.096 | 0.0020 | 0.02 | | | | | |
| W | 0.24 | 0.1 | 4.1 | 0.008 | 0.0010 | 0.068 | 0.0020 | 0.02 | | | | | |
| X | 0.22 | 0.4 | 4.0 | 0.009 | 0.0001 | 0.057 | 0.0043 | 0.01 | | | | | |
| Y | 0.23 | 1.1 | 3.5 | 0.009 | 0.0009 | 0.042 | 0.0029 | 0.03 | | | | | |
| Z | 0.20 | 1.0 | 3.4 | 0.009 | 0.0007 | 0.034 | 0.0039 | 0.03 | | | | | |
| AA | 0.18 | 0.8 | 3.4 | 0.045 | 0.0010 | 0.034 | 0.0033 | 0.04 | 0.0015 | 0.0150 | 0.01 | | |
| AB | 0.22 | 0.4 | 3.2 | 0.007 | 0.0007 | 0.060 | 0.0027 | 0.01 | | | | | |
| AC | 0.42 | 1.1 | 3.2 | 0.019 | 0.0002 | 0.035 | 0.0021 | 0.01 | | | | | |
| AD | 0.08 | 1.0 | 3.0 | 0.006 | 0.0002 | 0.077 | 0.0055 | 0.01 | | | | | |
| AE | 0.21 | 2.4 | 3.1 | 0.008 | 0.0010 | 0.023 | 0.0028 | 0.01 | | | | | |
| AF | 0.22 | 1.1 | 1.5 | 0.026 | 0.0006 | 0.069 | 0.0024 | 0.01 | | | | | |
| AG | 0.21 | 0.8 | 3.1 | 0.070 | 0.0007 | 0.059 | 0.0010 | 0.01 | | | | | |
| AH | 0.19 | 0.8 | 3.2 | 0.018 | 0.0080 | 0.069 | 0.0058 | 0.01 | | | | | |
| AI | 0.22 | 1.1 | 2.8 | 0.007 | 0.0004 | 0.250 | 0.0028 | 0.01 | | | | | |
| AJ | 0.25 | 0.8 | 3.3 | 0.006 | 0.0003 | 0.064 | 0.0150 | 0.01 | | | | | |
| AK | 0.21 | 0.6 | 3.3 | 0.018 | 0.0008 | 0.071 | 0.0017 | 0.001 | | | | | |
| AL | 0.18 | 0.01 | 3.1 | 0.009 | 0.0005 | 0.076 | 0.0015 | 0.15 | | | | | |

| Steel grade | Component composition (% by mass) Cr | Mo | V | Zr | W | Ca | Ce | La | Mg | Sn | $A_{C3}$ point |
|---|---|---|---|---|---|---|---|---|---|---|---|
| A | | | | | | | | | | | 789 |
| B | | | | | | | | | | | 820 |
| C | | | | | | | | | | | 829 |
| D | | | | | | | | | | | 781 |
| E | | | | | | | | | | | 789 |
| F | | | | | | | | | | | 728 |
| G | | | | | | | | | | | 806 |
| H | | | | | | | | | | | 837 |
| I | | | | | | | | | | | 822 |
| J | | | | | | | | | | | 748 |
| K | | | | | | | | | | | 773 |
| L | | | | | | | | | | | 763 |
| M | | | | | | | | | | | 770 |
| N | | | | | | | | | | | 776 |
| O | | | | | | | | | | | 778 |
| P | | | | | | | | | | | 767 |
| Q | | | | | | | | | | | 780 |
| R | | | | | | | | | | | 755 |
| S | | | | | | | | | | | 753 |
| T | | | | | | | | | | | 771 |
| U | | | | | | | | | | | 762 |
| V | 0.15 | | | | | | | | | | 790 |
| W | | 0.2 | | | | | | | | | 731 |
| X | 0.17 | 0.15 | 0.02 | | | | | | | | 746 |
| Y | | | | 0.012 | 0.01 | 0.0008 | 0.0009 | 0.0006 | 0.0004 | | 776 |
| Z | | | | | | | | | | 0.004 | 778 |
| AA | | | | | | | | | | 0.01 | 778 |
| AB | | | | | | | | | | | 764 |
| AC | | | | | | | | | | | 748 |
| AD | | | | | | | | | | | 843 |
| AE | | | | | | | | | | | 843 |
| AF | | | | | | | | | | | 851 |
| AG | | | | | | | | | | | 787 |

TABLE 1-continued

| | |
|---|---|
| AH | 795 |
| AI | 895 |
| AJ | 775 |
| AK | 778 |
| AL | 767 |

Underlined values are outside the scope of the present invention.

TABLE 2-1

| | | Hot rolling | | | | | Cold rolling | Annealing | | |
|---|---|---|---|---|---|---|---|---|---|---|
| No. | Steel grade | Slab heating temperature ° C. | Finish hot-rolling temperature ° C. | Average cooling rate to 700° C. *1 ° C./s | Average cooling rate to 650° C. *2 ° C./s | Coiling temperature ° C. | Rolling reduction % | Annealing temperature ° C. | Dew point ° C. | Average cooling rate ° C./S *3 |
| 1 | A | 1250 | 880 | 232 | 31 | 550 | 56 | 820 | −15 | 28 |
| 2 | | 1250 | 880 | 245 | 33 | 550 | 56 | 825 | −15 | 26 |
| 3 | | 1250 | 880 | 225 | 32 | 550 | 56 | 830 | −15 | 27 |
| 4 | | 1250 | 880 | 246 | 34 | 550 | 56 | 830 | −15 | 30 |
| 5 | | 1250 | 880 | 248 | 50 | 550 | 56 | 840 | −15 | 25 |
| 6 | | 1250 | 880 | 247 | 18 | 550 | 56 | 840 | −15 | 34 |
| 7 | | 1250 | 880 | 239 | 13 | 550 | 56 | 860 | −15 | 25 |
| 8 | | 1250 | 880 | 251 | 1 | 550 | 56 | 830 | −15 | 27 |
| 9 | B | 1250 | 880 | 235 | 3 | 550 | 56 | 887 | −15 | 30 |
| 10 | | 1240 | 880 | 237 | 35 | 550 | 56 | 902 | −15 | 24 |
| 11 | | 1210 | 880 | 241 | 37 | 550 | 56 | 896 | −15 | 25 |
| 12 | | 1180 | 880 | 242 | 34 | 550 | 56 | 890 | −15 | 29 |
| 13 | C | 1250 | 900 | 239 | 38 | 550 | 56 | 863 | −15 | 35 |
| 14 | | 1250 | 880 | 242 | 35 | 550 | 56 | 904 | −15 | 28 |
| 15 | | 1250 | 850 | 250 | 36 | 550 | 56 | 894 | −5 | 27 |
| 16 | | 1250 | 820 | 247 | 34 | 550 | 56 | 862 | −15 | 26 |
| 17 | D | 1250 | 880 | 250 | 32 | 550 | 56 | 822 | −15 | 30 |
| 18 | | 1250 | 880 | 100 | 31 | 550 | 56 | 830 | −15 | 25 |
| 19 | | 1250 | 880 | 40 | 38 | 550 | 56 | 834 | −6 | 28 |
| 20 | | 1250 | 880 | 20 | 34 | 550 | 56 | 848 | −15 | 30 |
| 21 | E | 1250 | 880 | 228 | 30 | 550 | 56 | 817 | −15 | 26 |
| 22 | | 1250 | 880 | 229 | 35 | 580 | 56 | 833 | −15 | 37 |
| 23 | | 1250 | 880 | 231 | 37 | 620 | 56 | 849 | −15 | 30 |
| 24 | | 1250 | 880 | 234 | 34 | 650 | 56 | 840 | −15 | 26 |
| 25 | F | 1250 | 880 | 227 | 35 | 550 | — | 804 | −15 | 25 |
| 26 | | 1250 | 880 | 229 | 33 | 550 | — | 812 | −15 | 28 |
| 27 | | 1250 | 880 | 230 | 32 | 550 | — | 830 | −15 | 30 |
| 28 | | 1250 | 880 | 231 | 36 | 550 | | 785 | −15 | 34 |
| 29 | G | 1250 | 880 | 230 | 35 | 550 | 56 | 846 | −15 | 28 |
| 30 | | 1250 | 880 | 234 | 38 | 550 | 56 | 835 | −15 | 27 |
| 31 | | 1250 | 880 | 238 | 37 | 550 | 56 | 830 | −15 | 30 |
| 32 | | 1250 | 880 | 237 | 34 | 550 | 56 | 800 | −15 | 26 |

| | | Annealing | | | Coating | | Tempering condition | | |
|---|---|---|---|---|---|---|---|---|---|
| No. | Steel grade | Cooling stop temperature ° C. | Holding temperature ° C. | Holding time s | Type of coating | Plating time s | Holding temperature ° C. | Holding time s | |
| 1 | A | 150 | 150 | 150 | Zn | 120 | | | Example |
| 2 | | 150 | 150 | 150 | Zn | 180 | 250 | 10 | Example |
| 3 | | 150 | 150 | 150 | Zn | 260 | 80 | 3600 | Example |
| 4 | | 150 | 170 | 150 | Zn | 320 | | | Comparative example |
| 5 | | 150 | 170 | 150 | Zn | 230 | | | Example |
| 6 | | 150 | 170 | 150 | Zn | 230 | | | Example |
| 7 | | 150 | 170 | 150 | Zn | 230 | | | Example |
| 8 | | 150 | 170 | 150 | Zn | 240 | | | Comparative example |
| 9 | B | 150 | 170 | 150 | Zn | 230 | | | Example |
| 10 | | 150 | 170 | 150 | Zn | 230 | | | Example |
| 11 | | 150 | 170 | 150 | Zn | 250 | | | Example |

TABLE 2-1-continued

| | | | | | | | | | |
|---|---|---|---|---|---|---|---|---|---|
| 12 | | 150 | 170 | 150 | Zn | 230 | | | Comparative example |
| 13 | C | 150 | 170 | 150 | Zn | 260 | | | Example |
| 14 | | 150 | 170 | 150 | Zn | 230 | | | Example |
| 15 | | 150 | 170 | 150 | Zn | 230 | | | Example |
| 16 | | 150 | 170 | 150 | Zn | 230 | | | Comparative example |
| 17 | D | 150 | 170 | 150 | Zn | 240 | 200 | 30 | Example |
| 18 | | 150 | 170 | 150 | Zn | 230 | 150 | 180 | Example |
| 19 | | 150 | 170 | 150 | Zn | 250 | | | Example |
| 20 | | 150 | 170 | 150 | Zn | 230 | | | Comparative example |
| 21 | E | 150 | 170 | 150 | Zn | 260 | | | Example |
| 22 | | 150 | 170 | 150 | Zn | 230 | | | Example |
| 23 | | 150 | 170 | 150 | Zn | 230 | | | Example |
| 24 | | 150 | 170 | 150 | Zn | 230 | | | Comparative example |
| 25 | F | 150 | 170 | 150 | Zn | 260 | | | Example |
| 26 | | 150 | 170 | 150 | Zn | 230 | | | Example |
| 27 | | 150 | 170 | 150 | Zn | 250 | | | Example |
| 28 | | 150 | 170 | 150 | Zn | 240 | | | Example |
| 29 | | 150 | 170 | 150 | Zn | 230 | | | Example |
| 30 | | 150 | 170 | 150 | Zn | 260 | | | Example |
| 31 | | 150 | 170 | 150 | Zn | 230 | | | Example |
| 32 | | 150 | 170 | 150 | Zn | 250 | | | Comparative Example |

*1 The average cooling rate from the finish hot-rolling temperature to 700° C.

*2 The average cooling rate from 700° C. (primary cooling stop temperature) to 650° C.

*3 The average cooling rate in the temperature range of the annealing temperature to 550° C.

Underlined values are outside the scope of the present invention.

TABLE 2-2

| | | Hot rolling | | | | | Cold rolling | Annealing | | |
|---|---|---|---|---|---|---|---|---|---|---|
| No. | Steel grade | Slab heating temperature ° C. | Finish hot-rolling temperature ° C. | Average cooling rate to 650° C. *1 ° C./s | Average cooling rate to 700° C. *2 ° C./s | Coiling temperature ° C. | Rolling reduction % | Annealing temperature ° C. | Dew point ° C. | Average cooling rate ° C./S *3 |
| 33 | H | 1250 | 880 | 241 | 31 | 550 | 56 | 865 | −15 | 30 |
| 34 | | 1250 | 880 | 235 | 32 | 550 | 56 | 870 | −15 | 18 |
| 35 | | 1250 | 880 | 236 | 33 | 550 | 56 | 880 | −19 | 6 |
| 36 | | 1250 | 880 | 238 | 35 | 550 | 56 | 870 | −15 | 2 |
| 37 | I | 1250 | 880 | 244 | 36 | 550 | 56 | 850 | −15 | 28 |
| 38 | | 1250 | 880 | 241 | 38 | 550 | 56 | 860 | −15 | 27 |
| 39 | | 1250 | 880 | 237 | 39 | 550 | 56 | 854 | −15 | 26 |
| 40 | | 1250 | 880 | 229 | 34 | 550 | 56 | 880 | −15 | 30 |
| 41 | J | 1250 | 880 | 235 | 35 | 550 | 56 | 790 | −15 | 25 |
| 42 | | 1250 | 880 | 234 | 31 | 550 | 56 | 780 | −15 | 35 |
| 43 | | 1250 | 880 | 228 | 30 | 550 | 56 | 820 | −15 | 29 |
| 44 | | 1250 | 880 | 229 | 32 | 550 | 56 | 819 | −15 | 30 |
| 45 | K | 1250 | 880 | 230 | 35 | 550 | 56 | 809 | −15 | 27 |
| 46 | | 1250 | 880 | 247 | 37 | 550 | 56 | 816 | −15 | 28 |
| 47 | | 1250 | 880 | 246 | 36 | 550 | 56 | 804 | −5 | 27 |
| 48 | | 1250 | 880 | 241 | 34 | 550 | 56 | 820 | −15 | 30 |
| 49 | L | 1250 | 880 | 300 | 33 | 550 | 56 | 793 | −15 | 26 |
| 50 | | 1250 | 880 | 220 | 32 | 550 | 56 | 801 | −15 | 35 |
| 51 | | 1250 | 880 | 150 | 35 | 550 | 56 | 821 | −7 | 29 |
| 52 | | 1250 | 880 | 15 | 38 | 550 | 56 | 810 | −15 | 27 |
| 53 | M | 1250 | 880 | 247 | 30 | 550 | 56 | 801 | −15 | 28 |
| 54 | | 1250 | 880 | 242 | 21 | 550 | 56 | 795 | −15 | 29 |
| 55 | | 1250 | 880 | 245 | 14 | 550 | 56 | 823 | −15 | 30 |
| 56 | | 1250 | 880 | 239 | 1 | 550 | 56 | 818 | −15 | 38 |
| 57 | N | 1250 | 880 | 234 | 34 | 550 | 56 | 806 | −15 | 27 |
| 58 | | 1250 | 880 | 235 | 35 | 550 | 56 | 815 | −15 | 29 |
| 59 | | 1250 | 880 | 237 | 36 | 550 | 56 | 831 | −15 | 28 |
| 60 | | 1250 | 880 | 236 | 32 | 550 | 56 | 824 | −15 | 28 |

TABLE 2-2-continued

| No. | Steel grade | Annealing: Cooling stop temperature ° C. | Annealing: Holding temperature ° C. | Annealing: Holding time s | Coating: Type of coating | Coating: Plating time s | Tempering condition: Holding temperature ° C. | Tempering condition: Holding time s | |
|---|---|---|---|---|---|---|---|---|---|
| 33 | H | 150 | 170 | 150 | Zn | 230 | | | Example |
| 34 | | 150 | 170 | 150 | Zn | 230 | | | Example |
| 35 | | 150 | 170 | 150 | Zn | 260 | | | Example |
| 36 | | 150 | 170 | 150 | Zn | 230 | | | Comparative example |
| 37 | I | 370 | 170 | 150 | Zn | 240 | | | Comparative example |
| 38 | | 340 | 170 | 150 | Zn | 230 | | | Example |
| 39 | | 320 | 170 | 150 | Zn | 230 | | | Example |
| 40 | | 120 | 170 | 150 | Zn | 250 | | | Example |
| 41 | J | 150 | 170 | 1750 | Zn | 230 | | | Comparative example |
| 42 | | 150 | 170 | 800 | Zn | 260 | | | Example |
| 43 | | 150 | 170 | 100 | Zn | 230 | | | Example |
| 44 | | 150 | 170 | 8 | Zn | 230 | | | Comparative example |
| 45 | K | 150 | 90 | 150 | Zn | 200 | | | Comparative example |
| 46 | | 150 | 150 | 150 | Zn | 180 | | | Example |
| 47 | | 150 | 170 | 150 | Zn | 160 | | | Example |
| 48 | | 150 | 220 | 150 | Zn | 120 | | | Comparative example |
| 49 | L | 150 | 170 | 150 | Zn | 230 | | | Example |
| 50 | | 150 | 170 | 150 | Zn | 230 | | | Example |
| 51 | | 150 | 170 | 150 | Zn | 230 | | | Example |
| 52 | | 150 | 170 | 150 | Zn | 240 | | | Comparative example |
| 53 | M | 150 | 170 | 150 | Zn | 230 | | | Example |
| 54 | | 150 | 170 | 150 | Zn | 230 | | | Example |
| 55 | | 150 | 170 | 150 | Zn | 250 | | | Example |
| 56 | | 150 | 170 | 150 | Zn | 230 | | | Comparative example |
| 57 | N | 150 | 170 | 150 | Zn—Ni | 400 | | | Comparative example |
| 58 | | 150 | 170 | 150 | Zn—Ni | 310 | | | Comparative example |
| 59 | | 150 | 170 | 150 | Zn—Ni | 240 | | | Example |
| 60 | | 150 | 170 | 150 | Zn—Ni | 130 | | | Example |

*1 The average cooling rate from the finish hot-rolling temperature to 700° C.

*2 The average cooling rate from 700° C. (primary cooling stop temperature) to 650° C.

*3 The average cooling rate in the temperature range of the annealing temperature to 550° C.

Underlined values are outside the scope of the present invention.

TABLE 2-3

| No. | Steel grade | Hot rolling: Slab heating temperature ° C. | Hot rolling: Finish hot-rolling temperature ° C. | Hot rolling: Average cooling rate to 700° C. *1 ° C./s | Hot rolling: Average cooling rate to 650° C. *2 ° C./s | Hot rolling: Coiling temperature ° C. | Cold rolling: Rolling reduction % | Annealing: Annealing temperature ° C. | Annealing: Dew point ° C. | Annealing: Average cooling rate ° C./S *3 |
|---|---|---|---|---|---|---|---|---|---|---|
| 61 | O | 1250 | 880 | 180 | 31 | 550 | 56 | 811 | −15 | 29 |
| 62 | | 1250 | 880 | 120 | 30 | 550 | 56 | 807 | −27 | 30 |

TABLE 2-3-continued

| | | | | | | | | | | |
|---|---|---|---|---|---|---|---|---|---|---|
| 63 | | 1250 | 880 | 60 | 37 | 550 | 56 | 830 | −15 | 29 |
| 64 | | 1250 | 880 | 35 | 35 | 550 | 56 | 806 | −15 | 27 |
| 65 | P | 1250 | 880 | 237 | 38 | 550 | 56 | 793 | −15 | 28 |
| 66 | | 1250 | 880 | 235 | 34 | 550 | 56 | 807 | −15 | 36 |
| 67 | | 1250 | 880 | 233 | 35 | 550 | 56 | 820 | −15 | 27 |
| 68 | | 1250 | 880 | 238 | 31 | 550 | 56 | 814 | −7 | 30 |
| 69 | Q | 1250 | 880 | 241 | 32 | 550 | 56 | 802 | −30 | 29 |
| 70 | | 1250 | 880 | 240 | 35 | 550 | 56 | 811 | −15 | 28 |
| 71 | | 1250 | 880 | 241 | 33 | 550 | 56 | 834 | −15 | 29 |
| 72 | | 1250 | 880 | 240 | 34 | 550 | 56 | 822 | −35 | 37 |
| 73 | R | 1250 | 880 | 246 | 36 | 550 | 56 | 789 | −15 | 30 |
| 74 | | 1250 | 880 | 238 | 31 | 550 | 56 | 781 | −15 | 29 |
| 75 | | 1250 | 880 | 237 | 32 | 550 | 56 | 805 | 15 | 28 |
| 76 | | 1250 | 880 | 237 | 34 | 550 | 56 | 810 | −6 | 26 |
| 77 | S | 1250 | 880 | 235 | 37 | 550 | 56 | 787 | −15 | 28 |
| 78 | | 1250 | 880 | 239 | 38 | 550 | 56 | 798 | −15 | 27 |
| 79 | | 1250 | 880 | 242 | 35 | 550 | 56 | 810 | −15 | 30 |
| 80 | | 1250 | 880 | 243 | 39 | 550 | 56 | 794 | −15 | 29 |
| 81 | T | 1250 | 880 | 400 | 35 | 550 | 56 | 808 | −15 | 33 |
| 82 | | 1250 | 880 | 140 | 34 | 550 | 56 | 819 | −15 | 27 |
| 83 | | 1250 | 880 | 30 | 32 | 550 | 56 | 824 | −15 | 28 |
| 85 | U | 1250 | 880 | 1148 | 36 | 550 | 56 | 798 | −15 | 30 |
| 86 | | 1250 | 880 | 500 | 32 | 550 | 56 | 789 | −15 | 28 |
| 87 | | 1250 | 880 | 170 | 31 | 550 | 56 | 808 | −26 | 29 |
| 88 | | 1250 | 880 | 35 | 30 | 550 | 56 | 804 | −15 | 27 |
| 89 | V | 1250 | 880 | 110 | 35 | 550 | 56 | 816 | −15 | 28 |
| 90 | | 1250 | 880 | 70 | 37 | 550 | 56 | 827 | −15 | 26 |
| 91 | | 1250 | 880 | 30 | 38 | 550 | 56 | 830 | −15 | 29 |
| 92 | | 1250 | 880 | 1187 | 36 | 550 | 56 | 824 | −15 | 30 |

| | | Annealing | | | Coating | | Tempering condition | | |
|---|---|---|---|---|---|---|---|---|---|
| No. | Steel grade | Cooling stop temperature ° C. | Holding temperature ° C. | Holding time s | Type of coating | Plating time s | Holding temperature ° C. | Holding time s | |
| 61 | O | 150 | 170 | 150 | Zn—Ni | 230 | | | Example |
| 62 | | 150 | 170 | 150 | Zn—Ni | 230 | | | Example |
| 63 | | 150 | 170 | 150 | Zn—Ni | 260 | | | Example |
| 64 | | 150 | 170 | 150 | Zn—Ni | 240 | | | Comparative example |
| 65 | P | 150 | 150 | 80 | Zn—Ni | 230 | | | Example |
| 66 | | 150 | 150 | 1840 | Zn—Ni | 230 | | | Comparative example |
| 67 | | 150 | 150 | 8 | Zn—Ni | 260 | | | Comparative example |
| 68 | | 150 | 150 | 600 | Zn—Ni | 230 | | | Example |
| 69 | Q | 150 | 150 | 300 | Zn—Ni | 250 | | | Example |
| 70 | | 150 | 150 | 1630 | Zn—Ni | 230 | | | Comparative example |
| 71 | | 150 | 150 | 7 | Zn—Ni | 230 | | | Comparative example |
| 72 | | 150 | 150 | 60 | Zn—Ni | 240 | | | Example |
| 73 | R | 150 | 150 | 1720 | Zn—Ni | 230 | | | Comparative example |
| 74 | | 150 | 150 | 6 | Zn—Ni | 230 | | | Comparative example |
| 75 | | 150 | 150 | 1200 | Zn—Ni | 260 | | | Example |
| 76 | | 150 | 150 | 900 | Zn—Ni | 250 | | | Example |
| 77 | S | 150 | 150 | 1750 | Zn—Fe | 230 | | | Comparative example |
| 78 | | 150 | 150 | 500 | Zn—Fe | 230 | | | Example |
| 79 | | 150 | 230 | 200 | Zn—Fe | 230 | | | Comparative example |
| 80 | | 150 | 80 | 400 | Zn—Fe | 240 | | | Comparative example |

TABLE 2-3-continued

| | | | | | | | | | |
|---|---|---|---|---|---|---|---|---|---|
| 81 | T | 150 | 150 | 150 | Zn—Fe | 230 | | | Example |
| 82 | | 150 | 150 | 150 | Zn—Fe | 230 | | | Example |
| 83 | | 150 | 150 | 150 | Zn—Fe | 260 | | | Comparative example |
| 85 | U | 150 | 150 | 150 | Zn—Fe | 230 | 100 | 120 | Example |
| 86 | | 150 | 150 | 150 | Zn—Fe | 250 | | | Example |
| 87 | | 150 | 150 | 150 | Zn—Fe | 230 | | | Example |
| 88 | | 150 | 150 | 150 | Zn—Fe | 230 | | | Comparative example |
| 89 | V | 150 | 150 | 150 | Zn Fe | 260 | | | Example |
| 90 | | 150 | 150 | 150 | Zn—Fe | 230 | | | Example |
| 91 | | 150 | 150 | 150 | Zn—Fe | 240 | | | Comparative example |
| 92 | | 150 | 150 | 150 | Zn—Fe | 230 | | | Example |

*1 The average cooling rate from the finish hot-rolling temperature to 700° C.
*2 The average cooling rate from 700° C. (primary cooling stop temperature) to 650° C.
*3 The average cooling rate in the temperature range of the annealing temperature to 550° C.
Underlined values are outside the scope of the present invention.

Underlined values are outside the scope of the present invention.

TABLE 2-4

| | | Hot rolling | | | | | Cold rolling | Annealing | | |
|---|---|---|---|---|---|---|---|---|---|---|
| No. | Steel grade | Slab heating temperature ° C. | Finish hot-rolling temperature ° C. | Average cooling rate to 700° C. *1 ° C./s | Average cooling rate to 650° C. *2 ° C./s | Coiling temperature ° C. | Rolling reduction % | Annealing temperature ° C. | Dew point ° C. | Average cooling rate ° C./S *3 |
| 93 | W | 1250 | 880 | 130 | 35 | 550 | 56 | 760 | −15 | 28 |
| 94 | | 1250 | 880 | 60 | 38 | 550 | 56 | 779 | −15 | 32 |
| 95 | | 1250 | 880 | 15 | 35 | 550 | 56 | 790 | −15 | 29 |
| 96 | | 1250 | 880 | 120 | 34 | 550 | 56 | 783 | −15 | 28 |
| 97 | X | 1250 | 880 | 238 | 1124 | 550 | 56 | 776 | −15 | 29 |
| 98 | | 1250 | 880 | 237 | 160 | 550 | 56 | 798 | −15 | 27 |
| 99 | | 1250 | 880 | 234 | 1 | 550 | 56 | 805 | −15 | 28 |
| 100 | | 1250 | 880 | 241 | 48 | 550 | 56 | 788 | −15 | 28 |
| 101 | Y | 1250 | 880 | 246 | 71 | 550 | 56 | 808 | −15 | 30 |
| 102 | | 1250 | 880 | 242 | 1 | 550 | 56 | 804 | −15 | 29 |
| 103 | | 1250 | 880 | 236 | 34 | 550 | 56 | 806 | −27 | 27 |
| 104 | | 1250 | 880 | 235 | 41 | 550 | 56 | 813 | −5 | 26 |
| 105 | Z | 1250 | 880 | 233 | 75 | 550 | 56 | 804 | −15 | 34 |
| 106 | | 1250 | 880 | 232 | 90 | 550 | 56 | 814 | −15 | 27 |
| 107 | | 1250 | 880 | 228 | 840 | 550 | 56 | 823 | −15 | 30 |
| 108 | | 1250 | 880 | 229 | 1 | 550 | 56 | 805 | −15 | 28 |
| 109 | AA | 1250 | 880 | 227 | 34 | 550 | 56 | 808 | −5 | 29 |
| 110 | | 1250 | 880 | 230 | 32 | 550 | 56 | 812 | −15 | 31 |
| 111 | | 1250 | 880 | 229 | 31 | 550 | 56 | 825 | −15 | 27 |
| 112 | | 1250 | 880 | 225 | 30 | 550 | 56 | 806 | −15 | 27 |
| 113 | AB | 1250 | 880 | 234 | 35 | 550 | 56 | 790 | −15 | 30 |
| 114 | | 1250 | 880 | 236 | 38 | 550 | 56 | 793 | −15 | 29 |
| 115 | | 1250 | 880 | 228 | 37 | 550 | 56 | 809 | −30 | 28 |
| 116 | | 1250 | 880 | 229 | 35 | 550 | 56 | 795 | −15 | 33 |
| 117 | AC | 1250 | 880 | 230 | 36 | 550 | 56 | 783 | −15 | 29 |
| 118 | AD | 1250 | 880 | 240 | 35 | 550 | 56 | 874 | −15 | 27 |
| 119 | AE | 1250 | 880 | 231 | 34 | 550 | 56 | 882 | −15 | 30 |
| 120 | AF | 1250 | 880 | 242 | 36 | 550 | 56 | 884 | −15 | 28 |
| 121 | AG | 1250 | 880 | 250 | 33 | 550 | 56 | 820 | −15 | 29 |
| 122 | AH | 1250 | 880 | 237 | 32 | 550 | 56 | 830 | −15 | 30 |
| 123 | AI | 1250 | 880 | 240 | 35 | 550 | 56 | 929 | −15 | 28 |
| 124 | AJ | 1250 | 880 | 245 | 35 | 550 | 56 | 802 | −15 | 27 |
| 125 | AK | 1250 | 880 | 237 | 36 | 550 | 56 | 816 | −15 | 26 |
| 126 | AL | 1250 | 880 | 239 | 30 | 550 | 56 | 807 | −15 | 30 |

TABLE 2-4-continued

| | | Annealing | | | Coating | | Tempering condition | | |
|---|---|---|---|---|---|---|---|---|---|
| No. | Steel grade | Cooling stop temperature ° C. | Holding temperature ° C. | Holding time s | Type of coating | Plating time s | Holding temperature ° C. | Holding time s | |
| 93 | W | 150 | 150 | 150 | Zn—Fe | 250 | 150 | 20 | Example |
| 94 | | 150 | 150 | 150 | Zn—Fe | 230 | 150 | 150 | Example |
| 95 | | 150 | 150 | 150 | Zn—Fe | 230 | | | Comparative example |
| 96 | | 150 | 150 | 150 | Zn—Fe | 230 | | | Example |
| 97 | X | 150 | 150 | 150 | Zn—Ni | 230 | | | Example |
| 98 | | 150 | 150 | 150 | Zn—Ni | 250 | | | Example |
| 99 | | 150 | 150 | 150 | Zn—Ni | 230 | | | Comparative example |
| 100 | | 150 | 150 | 150 | Zn—Ni | 230 | | | Example |
| 101 | Y | 150 | 150 | 150 | Zn—Ni | 240 | | | Example |
| 102 | | 150 | 150 | 150 | Zn—Ni | 230 | | | Comparative example |
| 103 | | 150 | 150 | 150 | Zn—Ni | 260 | | | Example |
| 104 | | 150 | 150 | 150 | Zn—Ni | 230 | | | Example |
| 105 | Z | 150 | 150 | 150 | Zn—Ni | 250 | | | Example |
| 106 | | 150 | 150 | 150 | Zn—Ni | 230 | | | Example |
| 107 | | 150 | 150 | 1200 | Zn—Ni | 230 | | | Example |
| 108 | | 150 | 150 | 150 | Zn—Ni | 260 | | | Comparative example |
| 109 | AA | 150 | 150 | 150 | Zn—Ni | 230 | | | Example |
| 110 | | 270 | 120 | 150 | Zn—Ni | 240 | | | Example |
| 111 | | 320 | 120 | 150 | Zn—Ni | 230 | | | Example |
| 112 | | 370 | 200 | 150 | Zn—Ni | 250 | | | Comparative example |
| 113 | AB | 150 | 200 | 150 | Zn—Ni | 230 | | | Example |
| 114 | | 360 | 200 | 150 | Zn—Ni | 260 | | | Comparative example |
| 115 | | 300 | 200 | 150 | Zn—Ni | 230 | | | Example |
| 116 | | 150 | 200 | 150 | Zn—Ni | 230 | | | Example |
| 117 | AC | 150 | 150 | 150 | Zn—Ni | 240 | | | Comparative example |
| 118 | AD | 150 | 150 | 150 | Zn—Ni | 230 | | | Comparative example |
| 119 | AE | 150 | 150 | 150 | Zn—Ni | 230 | | | Comparative example |
| 120 | AF | 150 | 150 | 150 | Zn—Ni | 230 | | | Comparative example |
| 121 | AG | 150 | 150 | 150 | Zn—Ni | 230 | | | Comparative example |
| 122 | AH | 150 | 150 | 150 | Zn Ni | 230 | | | Comparative example |
| 123 | AI | 150 | 150 | 150 | Zn—Ni | 230 | | | Comparative example |
| 124 | AJ | 150 | 150 | 150 | Zn—Ni | 230 | | | Comparative example |
| 125 | AK | 150 | 150 | 150 | Zn—Ni | 230 | | | Comparative example |

TABLE 2-4-continued

| | | | | | | | |
|---|---|---|---|---|---|---|---|
| 126 | AL | 150 | 150 | 150 | Zn—Ni | 230 | Comparative example |

*1 The average cooling rate from the finish hot-rolling temperature to 700° C.
*2 The average cooling rate from 700° C. (primary cooling stop temperature) to 650° C.
*3 The average cooling rate in the temperature range of the annealing temperature to 550° C.
Underlined values are outside the scope of the present invention.

2. Evaluation Method

With respect to the electrolytic zinc-based coated steel sheets produced under various production conditions, the microstructure fractions were examined by the analysis of the steel microstructures. The tensile characteristics, such as tensile strength, were evaluated by conducting a tensile test. The bendability was evaluated by a bending test. Evaluation methods were described below.

(Total Area Percentage of One or Two of Martensite Containing Carbide Having Average Particle Size of 50 nm or Less and Bainite Containing Carbide Having Average Particle Size of 50 nm or Less)

A test piece was taken from a portion of each of the electrolytic zinc-based coated steel sheets in the rolling direction and a direction perpendicular to the rolling direction. An L-cross-section extending in the thickness direction and a direction parallel to the rolling direction was mirror-polished, etched with Nital to reveal microstructures, and observed with a scanning electron microscope. The area percentage of each of martensite and bainite was examined by a point counting method in which a 16×15 grid of points at 4.8 μm intervals was placed on a region, measuring 82 μm×57 μm in terms of actual length, of a SEM image with a magnification of ×1,500 and the points on each phase were counted. The area percentage of martensite containing a carbide having an average particle size of 50 nm or less and bainite containing a carbide having an average particle size of 50 nm or less in the entire microstructure was defined as the average value of their area percentages from SEM images obtained by continuous observation of the entire cross-section in the thickness direction at a magnification of ×1,500. The area percentage of martensite containing a carbide having an average particle size of 50 nm or less and bainite containing a carbide having an average particle size of 50 nm or less in a region extending a surface of a base steel sheet to a depth of ⅛ of the thickness of the base steel sheet was defined as the average value of their area percentages from SEM images obtained by continuous observation of the region extending from the surface of the base steel sheet to a depth of ⅛ of the thickness of the base steel sheet at a magnification of ×1,500. Martensite and bainite appear as white microstructures in which blocks and packets are revealed within prior austenite grain boundaries and fine carbides are precipitated therein. A difficulty may lie in revealing carbides therein, depending on the crystallographic orientation of a block grain and the degree of etching. In that case, it is necessary to sufficiently perform etching and check it. The average particle size of the carbides in the martensite and the bainite was calculated by a method described below.

(Average Particle Size of Carbide in Martensite and Bainite)

A test piece was taken from a portion of each of the electrolytic zinc-based coated steel sheets in the rolling direction and a direction perpendicular to the rolling direction. An L-cross-section extending in the thickness direction and a direction parallel to the rolling direction was mirror-polished, etched with Nital to reveal microstructures, and observed with a scanning electron microscope. The number of carbides in prior austenite grains containing martensite and bainite was calculated from one SEM image obtained by continuous observation of the region extending from the surface of the base steel sheet to a depth of ⅛ of the thickness of the base steel sheet at a magnification of ×5,000. The total area of carbides in one grain was calculated by binarization of the microstructure. The area of one carbide particle was calculated from the number and the total area of the carbides. The average particle size of the carbides in the region extending from the surface of the base steel sheet to a depth of ⅛ of the thickness of the base steel sheet was calculated. A method for measuring the average particle size of the carbides in the entire microstructure is as follows: A point located at a depth of ¼ of the thickness of the base steel sheet was observed with a scanning electron microscope. Then the average particle size of the carbides in the entire microstructure was measured in the same way as the method for calculating the average particle size of the carbides in the region extending from the surface of the base steel sheet to a depth of ⅛ of the thickness of the base steel sheet. Here, the microstructure located at a depth of ¼ of the thickness of the base steel sheet was regarded as the average microstructure of the entire microstructure.

(Total Perimeter of Carbide Particles Having Average Particle Size of 50 nm or Less)

The total perimeter of individual carbide particles having an average particle size of 50 nm or less in martensite containing a carbide having an average particle size of 50 nm or less and bainite containing a carbide having an average particle size of 50 nm or less present in the region extending from the surface of the base steel sheet to a depth of ⅛ of the thickness of the base steel sheet was determined as follows: Regarding the individual carbide particles having an average particle size of 50 nm or less in martensite containing a carbide having an average particle size of 50 nm or less and bainite containing a carbide having an average particle size of 50 nm or less present in the region, the perimeters of the individual carbide particles were calculated by multiplying the average particle size of the individual carbide particles by circular constant pi 7c. The average of the resulting perimeters was determined. The total perimeter was determined by multiplying the average by the number of the carbide particles having an average particle size of 50 nm or less. The average particle size of the individual carbide particles is defined as the average value of lengths of the long axes and the short axes of the images of the carbide particles when the microstructure was binarized as described above.

(Tensile Test)

JIS No. 5 test pieces having a gauge length of 50 mm, a gauge width of 25 mm, and a thickness of 1.4 mm were taken from the electrolytic zinc-based coated steel sheets in the rolling direction and subjected to a tensile test at a cross head speed of 10 mm/min to measure tensile strength (TS) and elongation (El).

(Bending Test)

Bending test pieces having a width of 25 mm and a length of 100 mm were taken from the electrolytic zinc-based coated steel sheets in such a manner that the rolling direction was a bending direction. The test pieces were subjected to a test (n=3) by a pressing bend method according to JIS Z 2248 at a pressing rate of 100 mm/s and various bending radii. A bending radius at which no crack was formed in three test pieces was defined as a limit bending radius. Evaluation was performed on the basis of the ratio of the limit bending radius to the thickness of the steel sheet. Here, the presence or absence of a crack was checked by observation of outer sides of bent portions using a magnifier with a magnification of ×30. In the case where no crack was formed throughout a width of 25 mm of each test piece or in the case where at most five microcracks having a length of 0.2 μm or less were formed throughout a width of 25 mm of each test piece, the test piece was regarded as being free from cracks. The evaluation criterion for bendability was as follows: limit bending radius/thickness (R/t) 4.0.

(Hydrogen Analysis Method)

A strip-shaped plate having a long-axis length of 30 mm and a short-axis length of 5 mm was taken from the middle portion of each of the electrolytic zinc-based coated steel sheets in the width direction. The coating on the surfaces of the strip was completely removed with a handy router. Hydrogen analysis was performed with a thermal desorption spectroscopy system at a rate of temperature increase of 200° C./h. Note that the hydrogen analysis was performed immediately after the strip-shaped plate was taken and then the coating was removed. The cumulative amount of hydrogen released from a heating start temperature (25° C.) to 200° C. was measured and used as the amount of diffusible hydrogen in the steel.

3. Evaluation Result

Tables 3-1 to 3-4 present the evaluation results.

TABLE 3-1

| | | Steel microstructure | | | | Mechanical properties | | | | |
|---|---|---|---|---|---|---|---|---|---|---|
| No. | Steel grade | TM + B *1 % | TM + B *2 in surface layer portion % | Total perimeter of fine carbide *3 μm/mm² | Amount of diffusible hydrogen in steel ppm by mass | TS MPa | El % | TS × El MPa · % | R/t | |
| 1 | A | 97 | 87 | 67 | 0.03 | 1840 | 7.8 | 14352 | 3.1 | Example |
| 2 | | 96 | 88 | 61 | 0.07 | 1830 | 7.7 | 14091 | 3.6 | Example |
| 3 | | 97 | 88 | 64 | 0.06 | 1840 | 7.7 | 14168 | 3.3 | Example |
| 4 | | 95 | 90 | 63 | 0.29 | 1810 | 7.6 | 13756 | 4.2 | Comparative example |
| 5 | | 97 | 87 | 67 | 0.17 | 1820 | 7.8 | 14196 | 3.5 | Example |
| 6 | | 97 | 92 | 66 | 0.16 | 1830 | 7.7 | 14091 | 3.2 | Example |
| 7 | | 98 | 80 | 55 | 0.13 | 1840 | 7.7 | 14168 | 3.4 | Example |
| 8 | | 96 | 77 | 48 | 0.18 | 1820 | 7.8 | 14196 | 4.1 | Comparative example |
| 9 | B | 93 | 88 | 60 | 0.19 | 1570 | 8.7 | 13659 | 3.5 | Example |
| 10 | | 92 | 83 | 66 | 0.16 | 1560 | 8.7 | 13572 | 3.6 | Example |
| 11 | | 93 | 84 | 55 | 0.20 | 1570 | 8.7 | 13659 | 3.3 | Example |
| 12 | | 94 | 89 | 43 | 0.15 | 1580 | 8.7 | 13746 | 4.5 | Comparative example |
| 13 | C | 93 | 87 | 61 | 0.16 | 1580 | 8.6 | 13588 | 3.6 | Example |
| 14 | | 93 | 85 | 64 | 0.09 | 1580 | 8.6 | 13588 | 3.2 | Example |
| 15 | | 92 | 87 | 51 | 0.10 | 1570 | 8.7 | 13659 | 3.8 | Example |
| 16 | | 93 | 78 | 45 | 0.07 | 1580 | 8.7 | 13746 | 4.7 | Comparative example |
| 17 | D | 97 | 91 | 64 | 0.02 | 1830 | 7.8 | 14274 | 3.6 | Example |
| 18 | | 98 | 93 | 69 | 0.05 | 1840 | 7.7 | 14168 | 3.5 | Example |
| 19 | | 98 | 81 | 52 | 0.08 | 1840 | 7.7 | 14168 | 3.8 | Example |
| 20 | | 96 | 77 | 47 | 0.13 | 1820 | 7.8 | 14196 | 4.4 | Comparative example |
| 21 | E | 99 | 91 | 56 | 0.11 | 2020 | 7.4 | 14948 | 3.4 | Example |
| 22 | | 99 | 93 | 55 | 0.18 | 2010 | 7.4 | 14874 | 3.7 | Example |
| 23 | | 98 | 81 | 64 | 0.17 | 2000 | 7.4 | 14800 | 3.7 | Example |
| 24 | | 99 | 77 | 58 | 0.10 | 2030 | 7.3 | 14819 | 4.5 | Comparative example |
| 25 | F | 97 | 89 | 52 | 0.18 | 1950 | 7.5 | 14625 | 3.4 | Example |
| 26 | | 97 | 91 | 51 | 0.17 | 1950 | 7.5 | 14625 | 3.2 | Example |
| 27 | | 98 | 89 | 53 | 0.18 | 1960 | 7.5 | 14700 | 3.3 | Example |
| 28 | | 98 | 90 | 51 | 0.10 | 1960 | 7.4 | 14504 | 3.5 | Example |
| 29 | G | 96 | 86 | 68 | 0.18 | 1880 | 7.6 | 14288 | 3.2 | Example |
| 30 | | 94 | 87 | 65 | 0.06 | 1860 | 7.7 | 14322 | 3.4 | Example |
| 31 | | 91 | 84 | 67 | 0.10 | 1820 | 7.8 | 14196 | 3.6 | Example |
| 32 | | 88 | 74 | 65 | 0.32 | 1740 | 7.9 | 13746 | 4.5 | Comparative example |

*1 The total area percentage of martensite (TM) containing a carbide having an average particle size of 50 nm or less and bainite (B) containing a carbide having an average particle size of 50 nm or less in the entire microstructure.

*2 The total area percentage of TM containing a carbide having an average particle size of 50 nm or less and B containing a carbide having an average particle size of 50 nm or less in a region extending from a surface to a depth of 1/8 of the thickness of the sheet (surface layer portion).

*3 The total perimeter of carbide particles having an average particle size of 50 nm or less in TM containing a carbide having an average particle size of 50 nm or less and B containing a carbide having an average particle size of 50 nm or less present in the surface layer portion.

Underlined values are outside the scope of the present invention.

TABLE 3-2

| | | Steel microstructure | | | | Mechanical properties | | | | |
|---|---|---|---|---|---|---|---|---|---|---|
| No. | Steel grade | TM + B *1 % | TM + B *2 in surface layer portion % | Total perimeter of fine carbide *3 μm/mm² | Amount of diffusible hydrogen in steel ppm by mass | TS MPa | El % | TS × El MPa · % | R/t | |
| 33 | H | 92 | 84 | 70 | 0.13 | 1400 | 9.4 | 13160 | 3.3 | Example |
| 34 | | 91 | 84 | 68 | 0.13 | 1410 | 9.4 | 13254 | 3.4 | Example |
| 35 | | 90 | 83 | 60 | 0.18 | 1360 | 9.6 | 13056 | 3.0 | Example |
| 36 | | 84 | 79 | 61 | 0.24 | 1290 | 9.8 | 12642 | 4.2 | Comparative example |
| 37 | I | 92 | 76 | 48 | 0.15 | 1590 | 8.6 | 13674 | 4.8 | Comparative example |
| 38 | | 92 | 81 | 51 | 0.05 | 1580 | 8.7 | 13746 | 3.2 | Example |
| 39 | | 93 | 84 | 60 | 0.14 | 1600 | 8.6 | 13760 | 3.5 | Example |
| 40 | | 92 | 85 | 53 | 0.11 | 1580 | 8.7 | 13746 | 3.7 | Example |
| 41 | J | 99 | 75 | 45 | 0.16 | 2150 | 7.1 | 15265 | 4.1 | Comparative example |
| 42 | | 97 | 96 | 69 | 0.16 | 2160 | 7.1 | 15336 | 3.2 | Example |
| 43 | | 97 | 96 | 58 | 0.09 | 2160 | 7.1 | 15336 | 3.3 | Example |
| 44 | | 98 | 96 | 45 | 0.05 | 2140 | 7.1 | 15194 | 4.3 | Comparative example |
| 45 | K | 97 | 82 | 42 | 0.16 | 1850 | 7.7 | 14245 | 4.2 | Comparative example |
| 46 | | 98 | 82 | 54 | 0.20 | 1860 | 7.7 | 14322 | 3.8 | Example |
| 47 | | 97 | 83 | 66 | 0.09 | 1850 | 7.7 | 14245 | 3.3 | Example |
| 48 | | 96 | 78 | 42 | 0.14 | 1830 | 7.8 | 14274 | 4.4 | Comparative example |
| 49 | L | 99 | 84 | 56 | 0.10 | 1960 | 7.5 | 14700 | 3.5 | Example |
| 50 | | 99 | 82 | 64 | 0.11 | 1960 | 7.5 | 14700 | 3.6 | Example |
| 51 | | 98 | 81 | 60 | 0.06 | 1980 | 7.4 | 14652 | 3.8 | Example |
| 52 | | 98 | 68 | 41 | 0.19 | 1970 | 7.5 | 14775 | 4.1 | Comparative example |
| 53 | M | 98 | 93 | 62 | 0.09 | 1900 | 7.6 | 14440 | 3.1 | Example |
| 54 | | 97 | 89 | 57 | 0.16 | 1890 | 7.6 | 14364 | 3.7 | Example |
| 55 | | 99 | 82 | 54 | 0.17 | 1910 | 7.6 | 14516 | 3.4 | Example |
| 56 | | 98 | 78 | 46 | 0.15 | 1900 | 7.6 | 14440 | 4.4 | Comparative example |
| 57 | N | 99 | 93 | 64 | 0.21 | 1910 | 7.4 | 14134 | 4.2 | Comparative example |
| 58 | | 98 | 91 | 65 | 0.22 | 1880 | 7.5 | 14100 | 4.3 | Comparative example |
| 59 | | 99 | 91 | 60 | 0.09 | 1890 | 7.6 | 14364 | 3.2 | Example |
| 60 | | 99 | 92 | 68 | 0.06 | 1900 | 7.8 | 14820 | 3.0 | Example |

*1 The total area percentage of martensite (TM) containing a carbide having an average particle size of 50 nm or less and bainite (B) containing a carbide having an average particle size of 50 nm or less in the entire microstructure.
*2 The total area percentage of TM containing a carbide having an average particle size of 50 nm or less and B containing a carbide having an average particle size of 50 nm or less in a region extending from a surface to a depth of 1/8 of the thickness of the sheet (surface layer portion).
*3 The total perimeter of carbide particles having an average particle size of 50 nm or less in TM containing a carbide having an average particle size of 50 nm or less and B containing a carbide having an average particle size of 50 nm or less present in the surface layer portion.
Underlined values are outside the scope of the present invention.

TABLE 3-3

| | | Steel microstructure | | | | Mechanical properties | | | | |
|---|---|---|---|---|---|---|---|---|---|---|
| No. | Steel grade | TM + B*1 % | TM + B *2 in surface layer portion % | Total perimeter of fine carbide *3 μm/mm² | Amount of diffusible hydrogen in steel ppm by mass | TS MPa | El % | TS × El MPa · % | R/t | |
| 61 | O | 98 | 95 | 66 | 0.17 | 1960 | 7.5 | 14700 | 3.7 | Example |
| 62 | | 99 | 91 | 61 | 0.11 | 1950 | 7.5 | 14625 | 3.0 | Example |
| 63 | | 99 | 82 | 53 | 0.15 | 1940 | 7.5 | 14550 | 3.6 | Example |
| 64 | | 99 | 78 | 45 | 0.09 | 1950 | 7.5 | 14625 | 4.2 | Comparative example |
| 65 | P | 92 | 82 | 60 | 0.03 | 1670 | 8.3 | 13861 | 3.7 | Example |
| 66 | | 94 | 79 | 45 | 0.09 | 1690 | 8.4 | 14196 | 4.2 | Comparative example |
| 67 | | 92 | 82 | 42 | 0.02 | 1670 | 8.3 | 13861 | 4.2 | Comparative example |
| 68 | | 93 | 87 | 64 | 0.18 | 1680 | 8.2 | 13776 | 3.8 | Example |
| 69 | Q | 96 | 86 | 66 | 0.06 | 1830 | 7.8 | 14274 | 3.0 | Example |
| 70 | | 95 | 78 | 43 | 0.07 | 1820 | 7.8 | 14196 | 4.3 | Comparative example |

TABLE 3-3-continued

| | | Steel microstructure | | | | Mechanical properties | | | | |
|---|---|---|---|---|---|---|---|---|---|---|
| No. | Steel grade | TM + B*1 % | TM + B *2 in surface layer portion % | Total perimeter of fine carbide *3 μm/mm² | Amount of diffusible hydrogen in steel ppm by mass | TS MPa | El % | TS × El MPa · % | R/t | |
| 71 | | 97 | 91 | 49 | 0.06 | 1840 | 7.7 | 14168 | 4.3 | Comparative example |
| 72 | | 97 | 88 | 67 | 0.06 | 1830 | 7.8 | 14274 | 3.0 | Example |
| 73 | R | 94 | 76 | 49 | 0.08 | 1750 | 8.0 | 14000 | 4.6 | Comparative example |
| 74 | | 95 | 85 | 45 | 0.04 | 1760 | 8.0 | 14080 | 4.5 | Comparative example |
| 75 | | 92 | 86 | 69 | 0.12 | 1710 | 8.2 | 14022 | 3.6 | Example |
| 76 | | 93 | 84 | 60 | 0.04 | 1730 | 8.1 | 14013 | 3.9 | Example |
| 77 | S | 93 | 76 | 47 | 0.09 | 1760 | 8.0 | 14080 | 4.3 | Comparative example |
| 78 | | 93 | 85 | 57 | 0.07 | 1750 | 8.0 | 14000 | 3.6 | Example |
| 79 | | 94 | 79 | 48 | 0.18 | 1760 | 8.0 | 14080 | 4.1 | Comparative example |
| 80 | | 92 | 86 | 46 | 0.06 | 1730 | 8.1 | 14013 | 4.2 | Comparative example |
| 81 | T | 94 | 89 | 62 | 0.05 | 1800 | 7.8 | 14040 | 3.3 | Example |
| 82 | | 95 | 90 | 61 | 0.06 | 1810 | 7.8 | 14118 | 3.2 | Example |
| 83 | | 93 | 79 | 48 | 0.01 | 1790 | 7.8 | 13962 | 4.1 | Comparative example |
| 85 | U | 96 | 91 | 63 | 0.16 | 1890 | 7.6 | 14364 | 3.3 | Example |
| 86 | | 98 | 91 | 55 | 0.10 | 1920 | 7.6 | 14592 | 3.2 | Example |
| 87 | | 96 | 89 | 67 | 0.15 | 1900 | 7.6 | 14440 | 3.0 | Example |
| 88 | | 97 | 77 | 45 | 0.15 | 1900 | 7.6 | 14440 | 4.4 | Comparative example |
| 89 | V | 96 | 89 | 69 | 0.03 | 1840 | 7.7 | 14168 | 3.5 | Example |
| 90 | | 95 | 81 | 53 | 0.16 | 1830 | 7.7 | 14091 | 3.2 | Example |
| 91 | | 95 | 78 | 48 | 0.02 | 1830 | 7.7 | 14091 | 4.3 | Comparative example |
| 92 | | 96 | 90 | 55 | 0.04 | 1840 | 7.7 | 14168 | 3.7 | Example |

*1 The total area percentage of martensite (TM) containing a carbide having an average particle size of 50 nm or less and bainite (B) containing a carbide having an average particle size of 50 nm or less in the entire microstructure.
*2 The total area percentage of TM containing a carbide having an average particle size of 50 nm or less and B containing a carbide having an average particle size of 50 nm or less in a region extending from a surface to a depth of 1/8 of the thickness of the sheet (surface layer portion).
*3 The total perimeter of carbide particles having an average particle size of 50 nm or less in TM containing a carbide having an average particle size of 50 nm or less and B containing a carbide having an average particle size of 50 nm or less present in the surface layer portion.
Underlined values are outside the scope of the present invention.

TABLE 3-4

| | | Steel microstructure | | | | Mechanical properties | | | | |
|---|---|---|---|---|---|---|---|---|---|---|
| No. | Steel grade | TM + B*1 % | TM + B *2 in surface layer portion % | Total perimeter of fine carbide *3 μm/mm² | Amount of diffusible hydrogen in steel ppm by mass | TS MPa | El % | TS × El MPa · % | R/t | |
| 93 | W | 99 | 91 | 59 | 0.14 | 2130 | 7.1 | 15123 | 3.4 | Example |
| 94 | | 99 | 82 | 53 | 0.12 | 2110 | 7.2 | 15192 | 3.5 | Example |
| 95 | | 99 | 78 | 45 | 0.10 | 2090 | 7.2 | 15048 | 4.4 | Comparative example |
| 96 | | 99 | 96 | 65 | 0.03 | 2140 | 7.1 | 15194 | 3.5 | Example |
| 97 | X | 99 | 95 | 70 | 0.08 | 2060 | 7.3 | 15038 | 3.4 | Example |
| 98 | | 99 | 90 | 70 | 0.02 | 2040 | 7.3 | 14892 | 3.4 | Example |
| 99 | | 99 | 78 | 45 | 0.18 | 2050 | 7.3 | 14965 | 4.2 | Comparative example |
| 100 | | 99 | 91 | 61 | 0.03 | 2040 | 7.3 | 14892 | 3.6 | Example |
| 101 | Y | 99 | 92 | 66 | 0.16 | 1930 | 7.5 | 14475 | 3.5 | Example |
| 102 | | 99 | 77 | 43 | 0.06 | 1940 | 7.5 | 14550 | 4.3 | Comparative example |
| 103 | | 99 | 89 | 68 | 0.16 | 1930 | 7.5 | 14475 | 3.0 | Example |
| 104 | | 98 | 93 | 68 | 0.10 | 1920 | 7.6 | 14592 | 3.8 | Example |
| 105 | Z | 97 | 91 | 59 | 0.02 | 1840 | 7.7 | 14168 | 3.4 | Example |
| 106 | | 96 | 88 | 55 | 0.13 | 1820 | 7.8 | 14196 | 3.5 | Example |
| 107 | | 97 | 91 | 65 | 0.07 | 1830 | 7.7 | 14091 | 3.6 | Example |
| 108 | | 95 | 76 | 46 | 0.11 | 1800 | 7.8 | 14040 | 4.4 | Comparative example |
| 109 | AA | 94 | 86 | 67 | 0.20 | 1800 | 7.8 | 14040 | 3.9 | Example |
| 110 | | 96 | 88 | 57 | 0.14 | 1820 | 7.8 | 14196 | 3.6 | Example |
| 111 | | 96 | 89 | 56 | 0.08 | 1820 | 7.8 | 14196 | 3.6 | Example |
| 112 | | 95 | 77 | 49 | 0.16 | 1810 | 7.8 | 14118 | 4.2 | Comparative example |
| 113 | AB | 97 | 89 | 61 | 0.15 | 1820 | 7.8 | 14196 | 3.6 | Example |
| 114 | | 96 | 91 | 45 | 0.15 | 1810 | 7.8 | 14118 | 4.3 | Comparative example |
| 115 | | 95 | 86 | 61 | 0.03 | 1800 | 7.8 | 14040 | 3.0 | Example |
| 116 | | 95 | 85 | 64 | 0.10 | 1800 | 7.8 | 14040 | 3.3 | Example |
| 117 | AC | 98 | 96 | 65 | 0.12 | 2230 | 6.5 | 14495 | 3.4 | Comparative example |
| 118 | AD | 83 | 74 | 67 | 0.24 | 1480 | 9.0 | 13320 | 4.4 | Comparative example |

TABLE 3-4-continued

| | | Steel microstructure | | | | Mechanical properties | | | | |
|---|---|---|---|---|---|---|---|---|---|---|
| No. | Steel grade | TM + B*1 % | TM + B *2 in surface layer portion % | Total perimeter of fine carbide *3 μm/mm² | Amount of diffusible hydrogen in steel ppm by mass | TS MPa | El % | TS × El MPa · % | R/t | |
| 119 | AE | 94 | 89 | 41 | 0.22 | 1770 | 7.9 | 13983 | 4.2 | Comparative example |
| 120 | AF | 93 | 78 | 45 | 0.05 | 1310 | 9.8 | 12838 | 4.4 | Comparative example |
| 121 | AG | 94 | 79 | 60 | 0.20 | 1770 | 7.9 | 13983 | 4.7 | Comparative example |
| 122 | AH | 93 | 78 | 67 | 0.03 | 1760 | 8.0 | 14080 | 4.4 | Comparative example |
| 123 | AI | 93 | 87 | 44 | 0.10 | 1700 | 8.2 | 13940 | 4.4 | Comparative example |
| 124 | AJ | 96 | 89 | 47 | 0.18 | 1910 | 7.6 | 14516 | 4.4 | Comparative example |
| 125 | AK | 98 | 92 | 48 | 0.16 | 1830 | 7.9 | 14457 | 4.1 | Comparative example |
| 126 | AL | 94 | 79 | 66 | 0.03 | 1700 | 8.2 | 13940 | 4.7 | Comparative example |

*1 The total area percentage of martensite (TM) containing a carbide having an average particle size of 50 nm or less and bainite (B) containing a carbide having an average particle size of 50 nm or less in the entire microstructure.
*2 The total area percentage of TM containing a carbide having an average particle size of 50 nm or less and B containing a carbide having an average particle size of 50 nm or less in a region extending from a surface to a depth of ⅛ of the thickness of the sheet (surface layer portion).
*3 The total perimeter of carbide particles having an average particle size of 50 nm or less in TM containing a carbide having an average particle size of 50 nm or less and B containing a carbide having an average particle size of 50 nm or less present in the surface layer portion.
Underlined values are outside the scope of the present invention.

In the examples, a steel sheet satisfying TS 1,320 MPa, El≥7.0%, TS×El≥12,000, and R/t≤4.0 was rated acceptable and presented as "Example" in Tables 3-1 to 3-4. A steel sheet that does not satisfy at least one of TS 1,320 MPa, El≥7.0%, TS×El≥12,000, and R/t≤4.0 was rated unacceptable and presented as "Comparative example" in Tables 3-1 to 3-4. Underlines in Tables 1 to 3-4 indicate that the requirements, production conditions, and properties according to aspects of the present invention are not satisfied.

The invention claimed is:

1. A high-ductility, high-strength electrolytic zinc-based coated steel sheet having a tensile strength TS of 1.320 MPa or more, an elongation El of 7.0% or more, and TS/El=12.000 MPa-% or more comprising an electrolytic zinc-based coating on a surface of a base steel sheet, wherein the base steel sheet has a component composition containing, on a percent by mass basis, C: 0.12% or more and 0.40% or less, Si: 0.001% or more and 2.0% or less, Mn: 1.7% or more and 5.0% or less, P: 0.050% or less, S: 0.0050% or less, Al: 0.010% or more and 0.20% or less, N: 0.010% or less, and Sb: 0.002% or more and 0.10% or less, the balance being Fe and incidental impurities; and a steel microstructure in which a total area percentage of one or two of martensite containing a carbide having an average particle size of 50 nm or less and bainite containing a carbide having an average particle size of 50 nm or less is 90% or more in the entire steel microstructure, a total area percentage of one or two of the martensite containing a carbide having an average particle size of 50 nm or less and the bainite containing a carbide having an average particle size of 50 nm or less is 80% or more in a region extending from the surface of the base steel sheet to a depth of ⅛ of a thickness of the base steel sheet, and a total perimeter of individual carbide particles having an average particle size of 50 nm or less in the martensite containing a carbide having an average particle size of 50 nm or less and the bainite containing a carbide having an average particle size of 50 nm or less present in the region is 50 μm/mm² or more, the martensite being defined as a total of as-quenched martensite and tempered martensite, wherein an amount of diffusible hydrogen in steel is 0.20 ppm or less by mass, and wherein high-ductility, high-strength electrolytic zinc-based coarted steel sheet has a limit bending radius/thickness P/t of 4.0 or less in a predetermined bending test.

2. The high-ductility, high-strength electrolytic zinc-based coated steel sheet according to claim 1, wherein the component composition further contains, on a percent by mass basis, at least one selected from the group consisting of:

group A: B: 0.0002% or more and less than 0.0035%;

group B: one or two selected from Nb: 0.002% or more and 0.08% or less, and Ti: 0.002% or more and 0.12% or less;

group C: one or two selected from Cu: 0.005% or more and 1% or less, and Ni: 0.01% or more and 1% or less;

group D: one or two or more selected from Cr: 0.01% or more and 1.0% or less, Mo: 0.01% or more and less than 0.3%, V: 0.003% or more and 0.5% or less, Zr: 0.005% or more and 0.2% or less, and W: 0.005% or more and 0.2% or less;

group E: one or two or more selected from Ca: 0.0002% or more and 0.0030% or less, Ce: 0.0002% or more and 0.0030% or less, La: 0.0002% or more and 0.0030% or less, and Mg: 0.0002% or more and 0.0030% or less; and group F: Sn: 0.002% or more and 0.1% or less.

3. A method for producing the high-ductility, high-strength electrolytic zinc-based coated steel sheet according to claim 1, comprising:

a hot-rolling step of hot-rolling a steel slab having a component composition at a slab heating temperature of 1,200° C. or higher and a finish hot-rolling temperature of 840° C. or higher, performing cooling to a primary cooling stop temperature of 700° C. or lower at an average cooling rate of 40° C./s or more in a temperature range of the finish hot-rolling temperature to 700° C., performing cooling at an average cooling rate of 2° C./s or more in a temperature range of the primary cooling stop temperature to 650° C., performing cooling to a coiling temperature of 630° C. or lower, and performing coiling, the steel slab component composition containing, on a percent by mass basis, C: 0.12% or more and 0.40% or less, Si: 0.001% or more and 2.0% or less, Mn: 1.7% or more and 5.0% or less, P: 0.050% or less, S: 0.0050% or less, Al: 0.010% or more and 0.20% or less, N: 0.010% or less, and Sb: 0.002% or more and 0.10% or less, the balance being Fe and incidental impurities;

an annealing step of heating a steel sheet after the hot-rolling step to an annealing temperature equal to or higher than an $A_{C3}$ point or performing heating to an annealing temperature equal to or higher than an $A_{C3}$ point and performing soaking, performing cooling to a cooling stop temperature of 350° C. or lower at an average cooling rate of 3° C./s or more in a temperature range of the annealing temperature to 550° C., and performing holding at a holding temperature in a temperature range of 100° C. to 200° C. for 20 to 1,500 seconds; and a coating treatment step of cooling the steel sheet after the annealing step to room temperature and subjecting the steel sheet to electrolytic zinc-based coating for an electroplating time of 300 seconds or less.

4. A method for producing the high-ductility, high-strength electrolytic zinc-based coated steel sheet according to claim 2, comprising: a hot-rolling step of hot-rolling a steel slab having a component composition at a slab heating temperature of 1,200° C. or higher and a finish hot-rolling temperature of 840° C. or higher, performing cooling to a primary cooling stop temperature of 700° C. or lower at an average cooling rate of 40° C./s or more in a temperature range of the finish hot-rolling temperature to 700° C., performing cooling at an average cooling rate of 2° C./s or more in a temperature range of the primary cooling stop temperature to 650° C., performing cooling to a coiling temperature of 630° C. or lower, and performing coiling, the steel slab component composition containing, on a percent by mass basis, C: 0.12% or more and 0.40% or less, Si: 0.001% or more and 2.0% or less, Mn: 1.7% or more and 5.0% or less, P: 0.050% or less, S: 0.0050% or less, Al: 0.010% or more and 0.20% or less, N: 0.010% or less, and Sb: 0.002% or more and 0.10% or less, at least one selected from the group consisting of: group A: B: 0.0002% or more and less than 0.0035%; group B: one or two selected from Nb: 0.002% or more and 0.08% or less, and Ti: 0.002% or more and 0.12% or less; group C: one or two selected from Cu: 0.005% or more and 1% or less, and Ni: 0.01% or more and 1% or less; group D: one or two or more selected from Cr: 0.01% or more and 1.0% or less, Mo: 0.01% or more and less than 0.3%, V: 0.003% or more and 0.5% or less, Zr: 0.005% or more and 0.2% or less, and W: 0.005% or more and 0.2% or less; and group E: one or two or more selected from Ca: 0.0002% or more and 0.0030% or less, Ce: 0.0002% or more and 0.0030% or less, La: 0.0002% or more and 0.0030% or less, and Mg: 0.0002% or more and 0.0030% or less; and the balance being Fe and incidental impurities;

an annealing step of heating a steel sheet after the hot-rolling step to an annealing temperature equal to or higher than an $A_{C3}$ point or performing heating to an annealing temperature equal to or higher than an $A_{C3}$ point and performing soaking, performing cooling to a cooling stop temperature of 350° C. or lower at an average cooling rate of 3° C./s or more in a temperature range of the annealing temperature to 550° C., and performing holding at a holding temperature in a temperature range of 100° C. to 200° C. for 20 to 1,500 seconds; and a coating treatment step of cooling the steel sheet after the annealing step to room temperature and subjecting the steel sheet to electrolytic zinc-based coating for an electroplating time of 300 seconds or less.

5. The method according to claim 3, further comprising, after the hot-rolling step, a cold-rolling step of cold-rolling the steel sheet between the hot-rolling step and the annealing step.

6. The method according to claim 4, further comprising, after the hot-rolling step, a cold-rolling step of cold-rolling the steel sheet between the hot-rolling step and the annealing step.

7. The method according to claim 3, further comprising a tempering step of holding the steel sheet after the coating treatment step in a temperature range of ⁻250° C. or lower for a holding time t that satisfies formula (1) below:

$$(T+273)(\log t+4)\leq 2{,}700 \quad (1)$$

where in formula (1), T is a holding temperature in ° C. in the tempering step, and t is the holding time in seconds in the tempering step.

8. The method according to claim 4, further comprising a tempering step of holding the steel sheet after the coating treatment step in a temperature range of ⁻250° C. or lower for a holding time t that satisfies formula (1) below:

$$(T+273)(\log t+4)\leq 2{,}700 \quad (1)$$

where in formula (1), T is a holding temperature in ° C. in the tempering step, and t is the holding time in seconds in the tempering step.

9. The method according to claim 5, further comprising a tempering step of holding the steel sheet after the coating treatment step in a temperature range of ⁻250° C. or lower for a holding time t that satisfies formula (1) below:

$$(T+273)(\log t+4)\leq 2{,}700 \quad (1)$$

where in formula (1), T is a holding temperature in ° C. in the tempering step, and t is the holding time in seconds in the tempering step.

10. The method according to claim 6, further comprising a tempering step of holding the steel sheet after the coating treatment step in a temperature range of ⁻250° C. or lower for a holding time t that satisfies formula (1) below:

$$(T+273)(\log t+4)\leq 2{,}700 \quad (1)$$

where in formula (1), T is a holding temperature in ° C. in the tempering step, and t is the holding time in seconds in the tempering step.

* * * * *